US011810540B2

(12) United States Patent
Kai et al.

(10) Patent No.: US 11,810,540 B2
(45) Date of Patent: Nov. 7, 2023

(54) MUSICAL SOUND CONTROL DEVICE AND MUSICAL SOUND CONTROL METHOD

(71) Applicant: Roland Corporation, Shizuoka (JP)

(72) Inventors: Shuichi Kai, Shizuoka (JP); Yukio Shigeno, Shizuoka (JP)

(73) Assignee: Roland Corporation, Shizuoka (JP)

( * ) Notice: Subject to any disclaimer, the term of this patent is extended or adjusted under 35 U.S.C. 154(b) by 425 days.

(21) Appl. No.: 17/110,291

(22) Filed: Dec. 3, 2020

(65) Prior Publication Data

US 2021/0174775 A1 Jun. 10, 2021

(30) Foreign Application Priority Data

Dec. 4, 2019 (JP) ..... 2019-219986

(51) Int. Cl.
*G10H 1/053* (2006.01)
*G10H 1/12* (2006.01)
*G10H 1/46* (2006.01)

(52) U.S. Cl.
CPC ..... *G10H 1/053* (2013.01); *G10H 1/125* (2013.01); *G10H 1/46* (2013.01); *G10H 2210/325* (2013.01); *G10H 2250/055* (2013.01)

(58) Field of Classification Search
CPC ..... G10H 1/053; G10H 1/125; G10H 1/46; G10H 2210/325; G10H 2250/055
USPC ..... 381/98
See application file for complete search history.

(56) References Cited

U.S. PATENT DOCUMENTS 4,475,431 A * 10/1984 Kashio ..... G10H 1/187 84/665
11,417,303 B2 * 8/2022 Kanada ..... G10H 1/34
2002/0046640 A1 * 4/2002 Kondo ..... G10H 1/053 84/615
2006/0075882 A1 * 4/2006 Ikeya ..... G10H 1/46 84/609
2018/0268791 A1 * 9/2018 Okuda ..... G10H 1/344
2019/0073988 A1 * 3/2019 Ohta ..... G10H 1/0091
2019/0103080 A1 * 4/2019 Decker ..... G10H 1/40
(Continued)

FOREIGN PATENT DOCUMENTS

EP 1087373 3/2001
EP 1087373 A1 * 3/2001 ..... G10H 1/02
(Continued)

OTHER PUBLICATIONS

"Search Report of Europe Counterpart Application", dated May 3, 2021, pp. 1-12.
(Continued)

*Primary Examiner* — Christina M Schreiber
(74) *Attorney, Agent, or Firm* — JCIPRNET

(57) ABSTRACT

A musical sound that is rich in amusement can be provided. A musical sound control device includes: a plurality of operators; a musical sound processing part configured to repeat a process of controlling a musical sound in each of a plurality of steps in accordance with control information set by the plurality of operators; and a control part configured to stop an operation of the musical sound processing part in a case in which the process of controlling a musical sound of the plurality of all the steps using the musical sound processing part has gone through one cycle in a case in which a predetermined condition is satisfied.

19 Claims, 21 Drawing Sheets

(56) References Cited

U.S. PATENT DOCUMENTS

| | | | | |
|---|---|---|---|---|
| 2019/0392799 | A1* | 12/2019 | Danjyo | G10H 1/0008 |
| 2020/0372883 | A1* | 11/2020 | Sasaki | G10H 1/0008 |
| 2021/0174775 | A1* | 6/2021 | Kai | G10H 1/42 |
| 2021/0193096 | A1* | 6/2021 | Yamada | G10H 1/047 |
| 2021/0241737 | A1* | 8/2021 | Miki | G10H 1/0066 |
| 2021/0295806 | A1* | 9/2021 | Sakata | G10H 1/16 |
| 2022/0246120 | A1* | 8/2022 | Ae | G10H 1/26 |

FOREIGN PATENT DOCUMENTS

| | | | | |
|---|---|---|---|---|
| EP | 2717257 | | 4/2014 | |
| EP | 2717257 | A1 * | 4/2014 | G10H 1/0066 |
| JP | H10260683 | | 9/1998 | |
| JP | H10260683 | A * | 9/1998 | |
| JP | 2002023751 | | 1/2002 | |

OTHER PUBLICATIONS

"Office Action of Europe Counterpart Application", dated Jan. 14, 2022, p. 1-p. 6.

* cited by examiner

● VALUE SET BY PANEL OPERATION

| CLASSIFICATION | PARAMETER | VALUE | REMARK |
|---|---|---|---|
| ENTIRE DEVICE | BPM | 40～250 | |
| | MANUAL.PITCH | −24～+24 | SEMITONE UNIT |
| | MANUAL.CUTOFF | 0～100 | |
| | MANUAL.LEVEL | 0～100 | |
| | SOURCE.PITCH | OFF,SEQ1,SEQ2 | SET CONTROL SOURCE |
| | SOURCE.CUTOFF | OFF,SEQ1,SEQ2 | SET CONTROL SOURCE |
| | SOURCE.LEVEL | OFF,SEQ1,SEQ2 | SET CONTROL SOURCE |
| SEQ1 | SEQ1.ONOFF | 0,1 | 0(OFF),1(ON) |
| | SEQ1.ONESHOT | 0,1 | 0(OFF),1(ON) |
| | SEQ1.SYNC | 0,1 | 0(OFF),1(ON) |
| | SEQ1.LENGTH | 1～16 | |
| | SEQ1.NOTE | 1.0,2.0,4.0 | 1.0 (QUARTER NOTE), 2.0 (EIGHTH NOTE), 4.0 (SIXTEENTH NOTE) |
| | SEQ1.STEP[i].CURVE | 0,1,2,3,4 | i = 0～15、SET CURVE SHAPE |
| | SEQ1.STEP[i].PITCH.MIN | −24～+24 | i = 0～15、SEMITONE UNIT |
| | SEQ1.STEP[i].PITCH.MAX | −24～+24 | i = 0～15、SEMITONE UNIT |
| | SEQ1.STEP[i].CUTOFF.MIN | 0～100 | i = 0～15 |
| | SEQ1.STEP[i].CUTOFF.MAX | 0～100 | i = 0～15 |
| | SEQ1.STEP[i].LEVEL.MIN | 0～100 | i = 0～15 |
| | SEQ1.STEP[i].LEVEL.MAX | 0～100 | i = 0～15 |
| SEQ2 | (SAME CONTENT AS SEQ1) | | |

FIG. 4(A)

● VARIABLE USED IN CPU PROCESS

| CLASSIFICATION | VARIABLE | VALUE | REMARK |
|---|---|---|---|
| ENTIRE DEVICE | control.pitch | −24.0～+24.0 | |
| | control.cutoff | 0.0～100.0 | |
| | control.level | 0.0～100.0 | |
| SEQ1 | seq1.count | 0～LENGTH−1 | |
| | seq1.phase | 0.0～1.0 | |
| | seq1.wave | 0.0～1.0 | |
| | seq1.firstloop | 0,1 | ONE SHOT CONTROL FLAG |
| SEQ2 | (SAME CONTENT AS SEQ1) | | |

FIG. 4(B)

OPERATION OF PARAMETER MIN AND MAX

MUSICAL SOUND CONTROL DEVICE AND MUSICAL SOUND CONTROL METHOD

CROSS-REFERENCE TO RELATED APPLICATION

This application claims the priority benefits of Japanese application no. 2019-219986, filed on Dec. 4, 2019. The entirety of the above-mentioned patent application is hereby incorporated by reference herein and made a part of this specification.

BACKGROUND

Technical Field

The present disclosure relates to a musical sound control device and a musical sound control method.

Description of Related Art

Conventionally, there are automatic playing devices called step sequencers. A step sequencer repeats operations of assigning a plurality of phoneme pieces to steps of a predetermined number and reproducing the phoneme pieces for each predetermined long time in a predetermined reproduction order (for example, Patent Document 1). There are also cases in which an effect is assigned to a musical sound reproduced in each step.

PATENT DOCUMENTS

[Patent Document 1] Japanese Patent Laid-Open No. 2002-23751

In a conventional technology, when an operation for a final step ends, the process can only be repeated from the first step. In addition, it has not been considered to change the degree of effect with respect to time for each step.

It is desirable to provide a musical sound control device and a musical sound control method capable of providing musical sounds that are rich in amusement.

SUMMARY

According to one embodiment of the present disclosure, there is provided a musical sound control device including: a plurality of operators; a musical sound processing part configured to repeat a process of controlling a musical sound in each of a plurality of steps in accordance with control information set by the plurality of operators; and a control part configured to stop an operation of the musical sound processing part in a case in which the process of controlling a musical sound of the plurality of all the steps using the musical sound processing part has gone through one cycle in a case in which a predetermined condition is satisfied.

According to one embodiment of the present disclosure, there is provided a musical sound control device including: a plurality of operators; a musical sound processing part configured to repeat a process of controlling a musical sound in each of a plurality of steps in accordance with control information set by the plurality of operators; and a control part configured to set a change pattern selected from among a plurality of change patterns representing change of a value represented by the control information with respect to time within a step to each of a plurality of steps.

In addition, according to one embodiment of the present disclosure, there is provided a musical sound control method including: controlling a musical sound in each of a plurality of steps in accordance with control information set by a plurality of operators by using a musical sound control device; and setting a change pattern selected from among a plurality of change patterns (CURVE) representing a change of a value represented by the control information with respect to time within a step to each of a plurality of steps by using the musical sound control device.

BRIEF DESCRIPTION OF THE DRAWINGS

FIG. 4(A) and FIG. 4(B) illustrates information that is stored in a storage device.

DESCRIPTION OF THE EMBODIMENTS

Hereinafter, an embodiment will be described with reference to the drawings. The configuration of the embodiment is an example, and the disclosure is not limited to the configuration of the embodiment.

Figure 1:
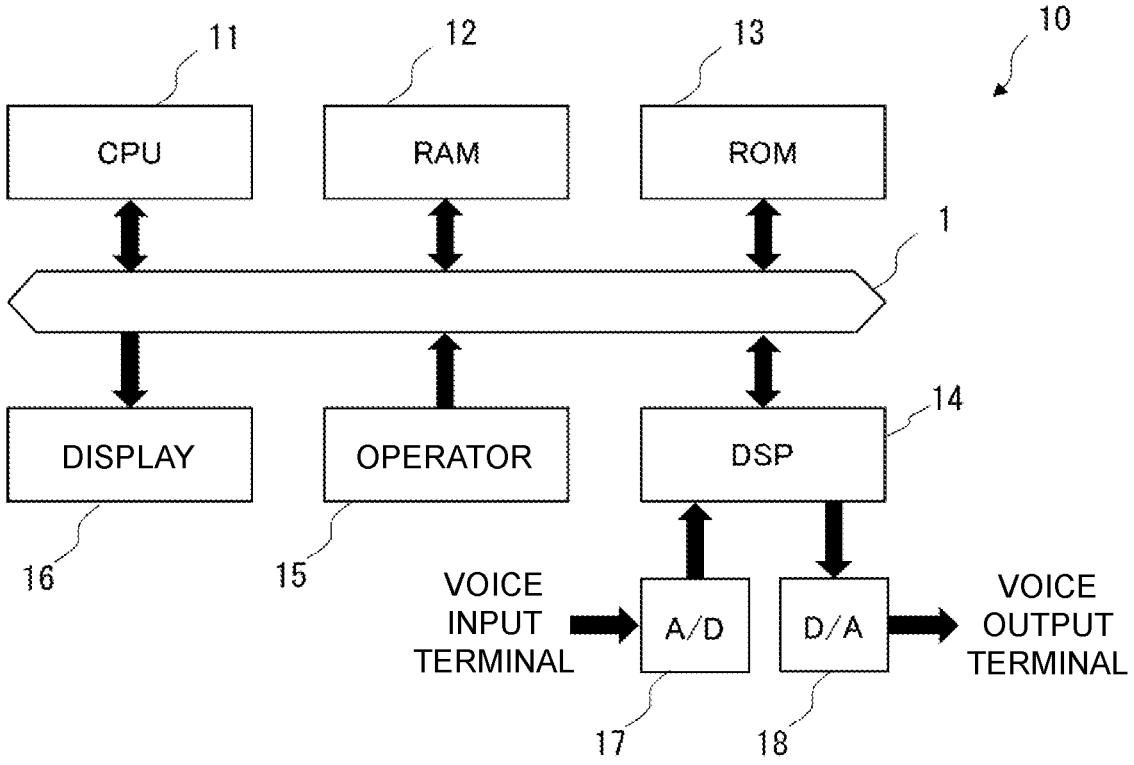
FIG. 1 illustrates the entire configuration of an example of a musical sound control device.

FIG. 1 illustrates an example of the configuration of a musical sound control device 10 according to an embodiment. The musical sound control device 10 includes a central processing unit (CPU) 11 that controls the overall operation of the musical sound control device 10. The CPU 11 is connected to a random access memory (RAM) 12, a read only memory (ROM) 13, a digital signal processor (DSP) 14, an operator 15, and a display 16 through a bus 1.

The RAM 12 is used as a work area of the CPU 11 and a storage area of programs and data. The ROM 13 is used as a storage area of programs and data. The RAM 12 and the ROM 13 are examples of a storage device (storage medium).

The musical sound control device 10 has an audio input terminal to which a musical sound generated in accordance with playing of an instrument and a musical sound according to reproduction are input. A musical sound signal input from the audio input terminal is converted into a digital signal by an A/D converter 17 and is input to the DSP 14. The DSP 14 assigns an effect to a musical sound signal and outputs the musical sound signal to which the effect has been assigned. The musical sound signal is converted into an analog signal by a D/A converter 18 and is output from an audio output terminal. The output musical sound signal is amplified by an amplifier and is emitted as a sound from a speaker.

The operator 15 is a knob, a button, a switch, and the like operated by a user (operator) using the musical sound control device. The display 16 is a display, a lamp (an LED or the like), or the like and is used for displaying information.

Figure 2:
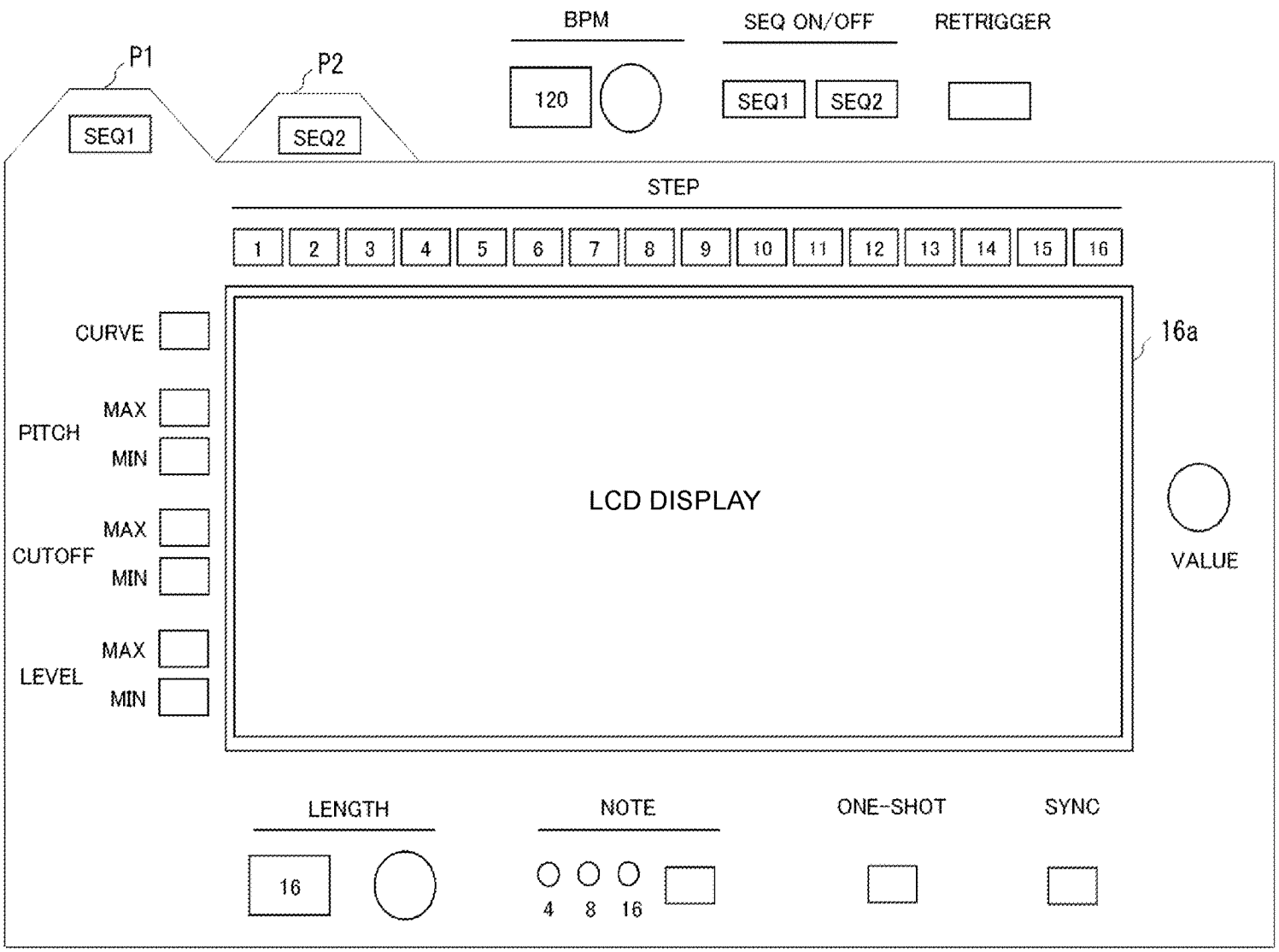
FIG. 2 is a diagram illustrating a panel of an operator included in a musical sound control device.

FIG. 2 and FIG. 3(A) to FIG. 3(C) are diagrams illustrating a panel of an operator included in the musical sound control device 10. The panel includes a plurality of operators 15 and a display 16. In this embodiment, two independent step sequencers (SEQ1 and SEQ2) operate independently (in parallel). For this reason, the panel includes a panel P1 used for the step sequencer SEQ1 and a panel P2 used for the step sequencer SEQ2. In FIG. 2, the panels P1 and P2 are schematically illustrated as tabs. Both the panels P1 and P2 have the same configuration. By operating sequencer selection buttons (SEQ1 and SEQ2) disposed in a tab portion (Tab Portion), the panel P1 or P2 is selected, and a setting of a corresponding step sequencer can be performed.

In FIG. 2, operators common to the step sequencers SEQ1 and SEQ2 are illustrated on an upper side in the panel P1. As an operator used for setting a tempo, a knob used for adjusting a beat per minute (BPM) and a display representing the set BPM are illustrated. On the right side thereof, on/off buttons of the step sequencers SEQ1 and SEQ2 are disposed. The on/off buttons are self-illumination type buttons and are lighted up in the case of on. On the right side thereof, a retrigger button is disposed. When the retrigger button is pressed in a state in which synchronization (SYNC) is on, the step sequencer is cued in synchronization with the operation of the retrigger button. When synchronization (SYNC) is in the on state in both the step sequencers SEQ1 and SEQ2, cueing of the step sequencers SEQ1 and SEQ2 is simultaneously performed, and consequently, the cueing of the step sequencers SEQ1 and SEQ2 is synchronized.

The panel P1 includes an LCD display 16*a* as a display 16 at the center. On an upper side of the display 16*a*, 16 buttons (step selection buttons) for designating steps are disposed in one row. In this embodiment, a predetermined number of steps can be selected with 16 as a maximum number. By pressing each button, a corresponding step can be designated, and a parameter setting for the step can be performed.

In addition, the panel P1 includes parameter selection buttons used for selecting seven parameters (CURVE, PITCH (MIN), PITCH (MAX), CUTOFF (MIN), CUTOFF (MAX), LEVEL (MIN), LEVEL (MAX)) for each step. Each of the parameter selection buttons is a self-illumination type switch and is lighted up when pressed and indicates that the parameter is selected.

More specifically, on the left side of the display in the panel P1, a button for setting a curve (CURVE) is disposed. A curve represents a form of change (envelope) of a degree of effect with respect to time that is assigned in a corresponding step. In addition, below the curve button, buttons used for selecting a maximum value (MAX) and a minimum value (MIN) of a pitch (PITCH), buttons used for selecting a maximum value (MAX) and a minimum value (MIN) of a cutoff (CUTOFF) representing a cutoff frequency, and buttons used for selecting a maximum value (MAX) and a minimum value (MIN) of a level (LEVEL) representing a volume are disposed.

Below the display 16*a*, a knob used for setting the number of steps (LENGTH) and a display that displays the set number of steps are disposed. On the right side thereof, there is a button used for selecting a note (NOTE) setting a speed of advance of one step, and there are three LEDs representing whether a set musical note is a quarter note, an eighth note, or a sixteenth note, and an LED corresponding to the selected musical note is lighted up.

In addition, self-illumination type buttons representing on/off of a one-shot (ONE-SHOT) and synchronization (SYNC) are disposed, and an LED included in each button is lighted up at the time of being turned on. The button for synchronization (SYNC) represents a state of synchronization with an operation of the retrigger button (on) or no synchronization with an operation of the retrigger button (off) according to being on/off.

On the right side of the display 16*a*, a knob that is used for adjusting a value (VALUE) is disposed. A sequencer is selected using the sequencer selection button, a step is selected using the step selection button, and a parameter is selected using the parameter selection button. Further, the knob operates as a knob that increases/decreases the selected parameter. A user can set a setting value of each parameter using the "VALUE" knob.

Here, a one shot is one of operation modes of a sequencer. In a case in which the one shot is off, when a process for the last step among steps of a predetermined number ends, the process returns to the first step. Such a loop is repeated. On the other hand, in a case in which the one shot is on, in a case in which the process for all the steps of the predetermined number has gone through one cycle, the sequencer stops the operation. At this time, as an operation of the musical sound control device 10, an operation at the time of stopping the operation of the sequencer is performed. At the time of stopping the operation, pitch control, cutoff control, and level control that have been performed by the step sequencer until that time stop, and control is performed in accordance with manual setting values.

Figure 3A:
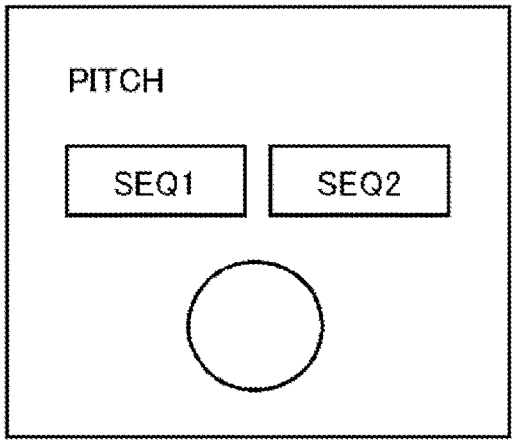
FIG. 3(A) to FIG. 3(C) are diagrams illustrating a panel of an operator included in a musical sound control device.

FIG. 3(A) illustrates operators for selecting a control source of a pitch from among the step sequencers SEQ1 and SEQ2 and a user (manual). The operators are formed from self-illumination type buttons for respectively selecting the step sequencers SEQ1 and SEQ2 and a knob for changing the pitch. When the button for the step sequencer SEQ1 or SEQ2 is on, the pitch assigns an effect to a musical sound (Musical Sound) (voice (Sound)) using parameters relating to a pitch set for the sequencer corresponding to the pressed button. In a case in which the buttons for the step sequencers SEQ1 and SEQ2 are off, a pitch shift value can be controlled manually by operating the knob. By using this knob, a pitch shift value can be set in the range of +/−2 octaves (here, +/−2 octaves are +/−24 semitones).

Figure 3B:
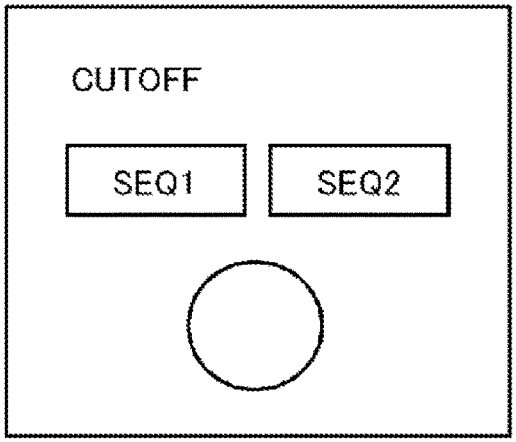

FIG. 3(B) illustrates operators for selecting a control source of the cutoff frequency from among the step sequencers SEQ1 and SEQ2 and a manual operation. The operators are formed from buttons used for respectively selecting the step sequencers SEQ1 and SEQ2 and a knob used for changing the cutoff frequency. When the button for the step sequencer SEQ1 or SEQ2 is pressed, an effect for a musical sound (voice) is assigned using parameters relating to the cutoff frequency set for the sequencer corresponding to the pressed button. On the other hand, in a case in which the buttons for the step sequencers SEQ1 and SEQ2 are off, the cutoff frequency can be controlled manually by operating the knob.

Figure 3C:
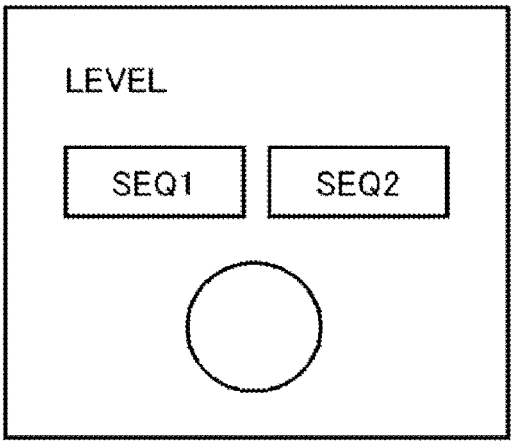

FIG. 3(C) illustrates operators for selecting a control source of the volume (level) from among the step sequencers SEQ1 and SEQ2 and the user. The operators are formed from buttons used for respectively selecting the step sequencers SEQ1 and SEQ2 and a knob used for changing the level. Similar to the pitch and the cutoff frequency, when the button for the step sequencer SEQ1 or SEQ2 is on, an effect for a musical sound (voice) is assigned using parameters relating to a level set for the sequencer corresponding to the pressed button. On the other hand, in a case in which both the buttons are off, the volume (level) can be controlled manually by operating the knob.

FIGS. 4(A) and 4(B) illustrate control information of the musical sound control device 10 that is stored in a storage device (a memory: the RAM 12). In tables represented in FIGS. 4(A) and 4(B), items represented using capital letters represent values (parameters) set by panel operations, and items represented using small letters are variables used for the process of the CPU 11. This similarly applies also to flowcharts described below. Such parameters and variables (control information) are stored in the RAM 12 in accordance with settings using the panel by the CPU 11.

A value set by a panel operation is a value that is set by operating the operators illustrated in FIG. 2 and FIG. 3(A) to FIG. 3(C). As variables used for the process of the CPU, there are the following variables.

A variable "control.pitch" is a value of pitch control performed by the musical sound control device 10. An effect relating to the pitch of the DSP 14 is set in accordance with this value. A variable "control.cutoff" is a value of cutoff control performed by the musical sound control device 10. In accordance with this value, an effect relating to cutoff of the DSP 14 is set. A variable "control.level" is a value of level control performed by the musical sound control device 10. An effect relating to the level of the DSP 14 is set in accordance with this value.

A variable "seq1.count" is a counter that represents a position of a step. For example, when LENGTH=4, counting is performed as below.

0, 1, 2, 3, 0, 1, 2, 3, . . . .

A variable "seq1.phase" is a value of a phase that monotonously increases from 0.0 to 1.0 in the section of one step. A variable "seq1.wave" is a value after performing waveform processing based on the CURVE for "seq1.phase". A variable "seq1.firstloop" is a flag that represents whether or not the loop is the first loop and is represented by "1" in a case in which the loop is the first loop and is represented by "0" otherwise. Here, the loop is a series of steps, which are designated using LENGTH, going through one cycle.

Figure 5:
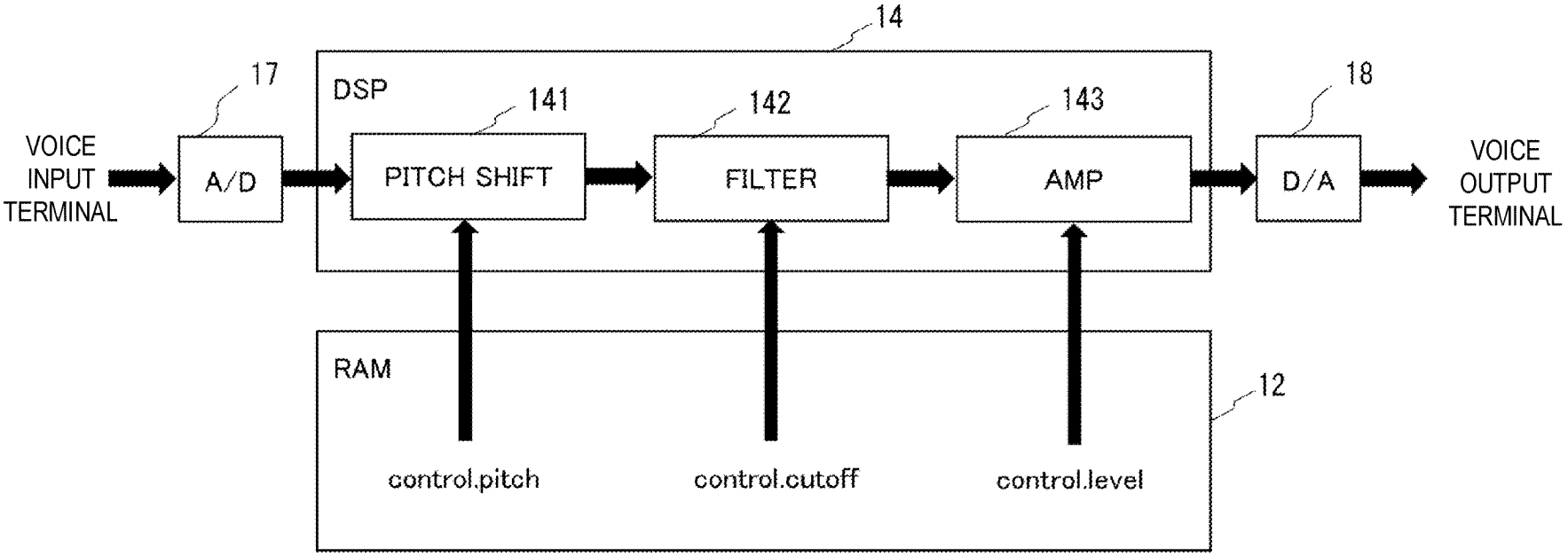
FIG. 5 is an explanatory diagram of the process of a DSP.

FIG. 5 is an explanatory diagram of the process of the DSP 14. In FIG. 5, the DSP 14 performs the process of assigning an effect to a signal of a musical sound input from the A/D converter 17 as a pitch shift (PITCH SHIFT) 141, a filter (FILTER) 142, and an amplifier (AMP) 143.

The pitch shift 141 performs the process of changing the pitch of a voice signal (a pitch shift process) in accordance with a designated value. The pitch shift 141 refers to the variable "control.pitch" set by the CPU 11 and assigns an effect with characteristics according to this value.

The filter 142, for example, is a low pass filter that changes frequency characteristics of a musical sound signal. The filter 142 performs the process of changing a musical tone of a voice signal by passing components of frequencies that are equal to or lower than a cutoff frequency on the basis of the cutoff frequency corresponding to a designated value (the variable "control.cutoff"). Instead of the low pass filter, a high pass filter, a band pass filter, or the like may be applied. An AMP 143 performs the process of changing the amplitude of a musical sound signal corresponding to a designated value (the variable "control.level").

Figure 6:
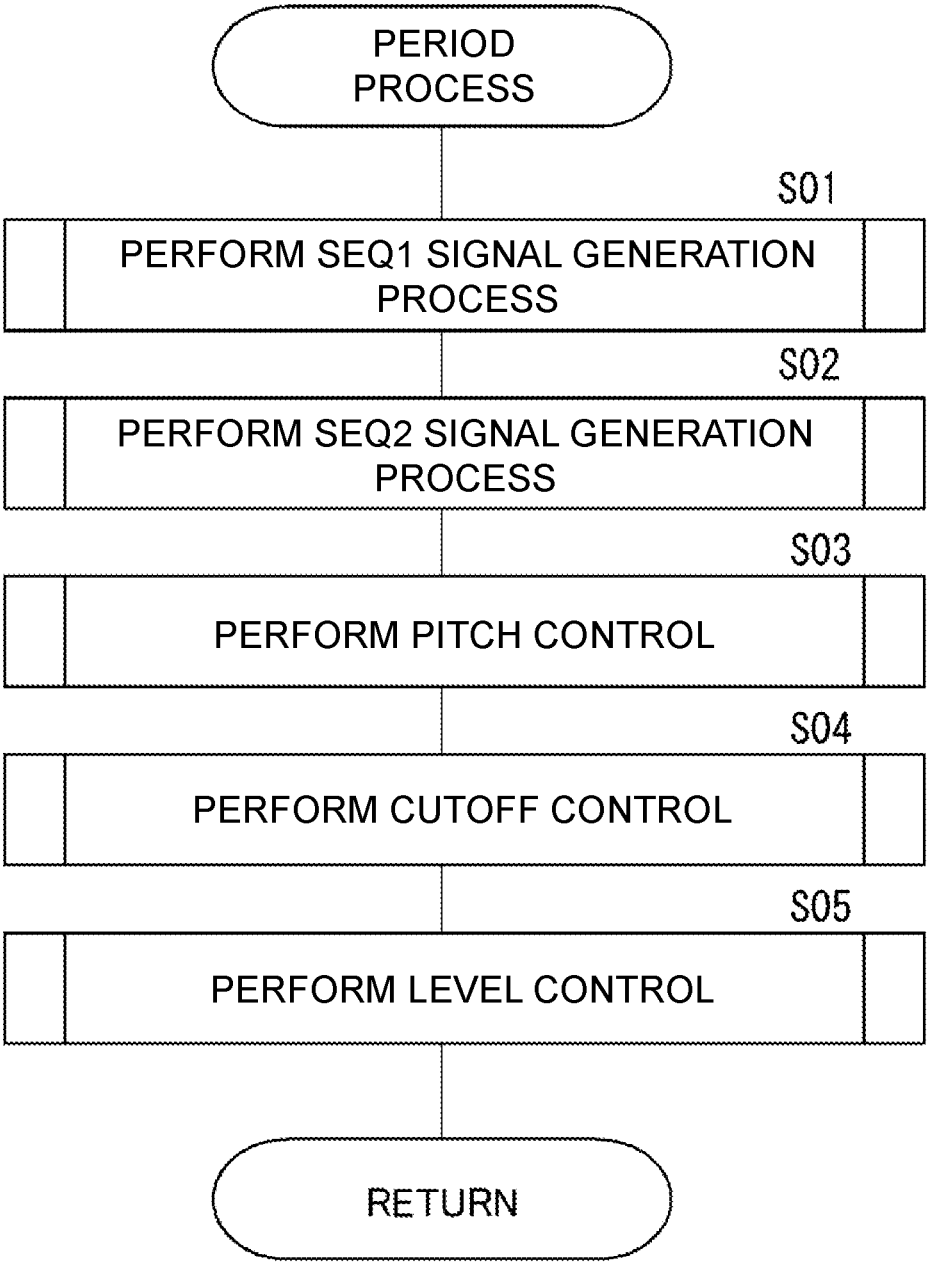
FIG. 6 illustrates an example of a period process of a CPU.

FIG. 6 is a flowchart illustrating an example of a period process that is executed by the CPU 11. The period process is started and executed with a period of 1 msec using a timer. The period may be longer or shorter than 1 msec. By the period process, generation of control signals of the step sequencers SEQ1 and SEQ2 and setting of a control value of the DSP 14 are performed.

More specifically, in Step S01, a subroutine of a signal generation process for the step sequencer SEQ1 is executed by the CPU 11. In Step S02, the CPU 11 executes a subroutine of a signal generation process for the step sequencer SEQ2. In Step S03, the CPU 11 executes a subroutine of PITCH (pitch) control. In Step S04, the CPU 11 executes a subroutine of CUTOFF (cutoff) control. In Step S05, the CPU 11 executes a subroutine of LEVEL (level) control.

Figure 7:
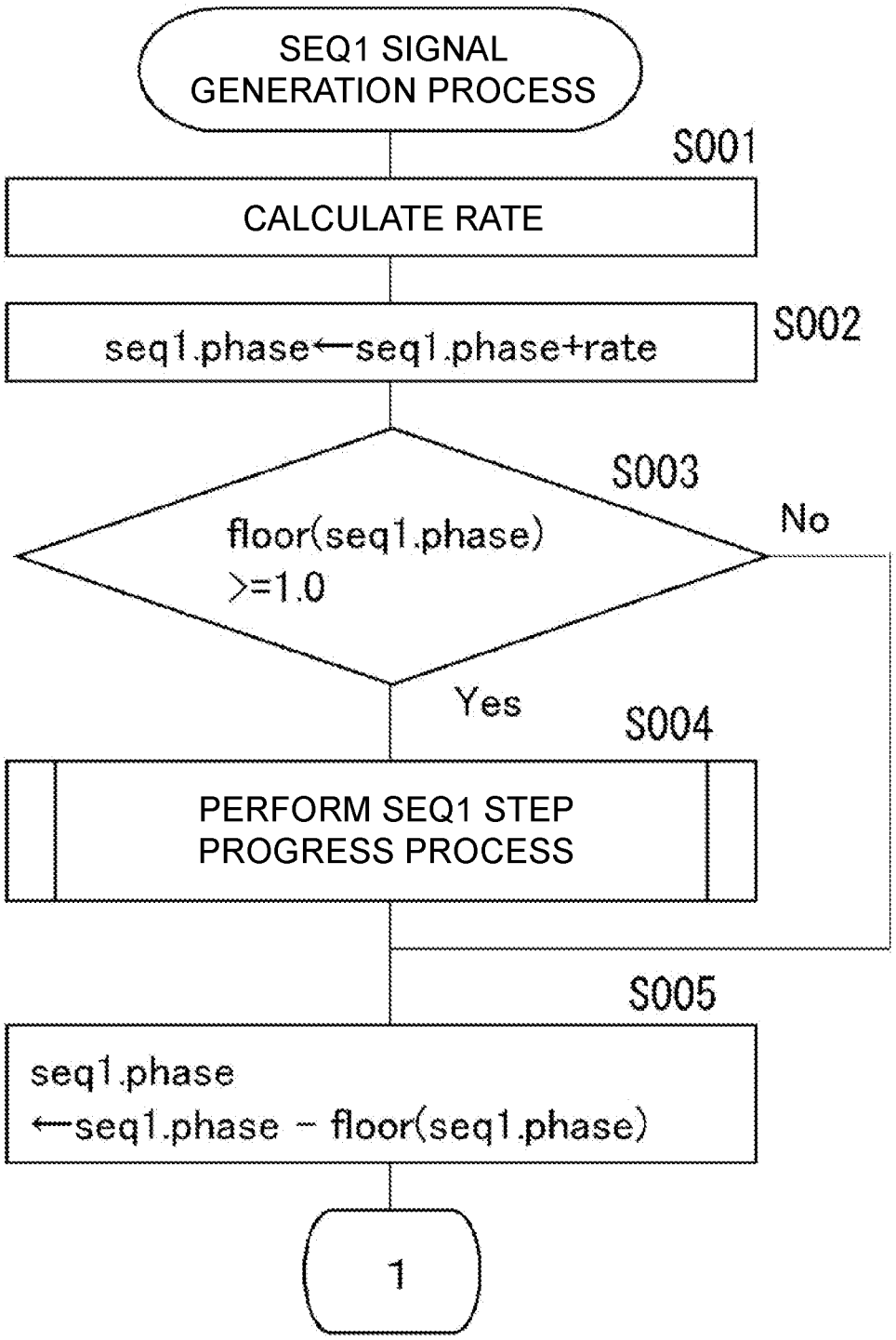
FIG. 7 illustrates an example of a signal generation process of a sequencer.
Figure 8:
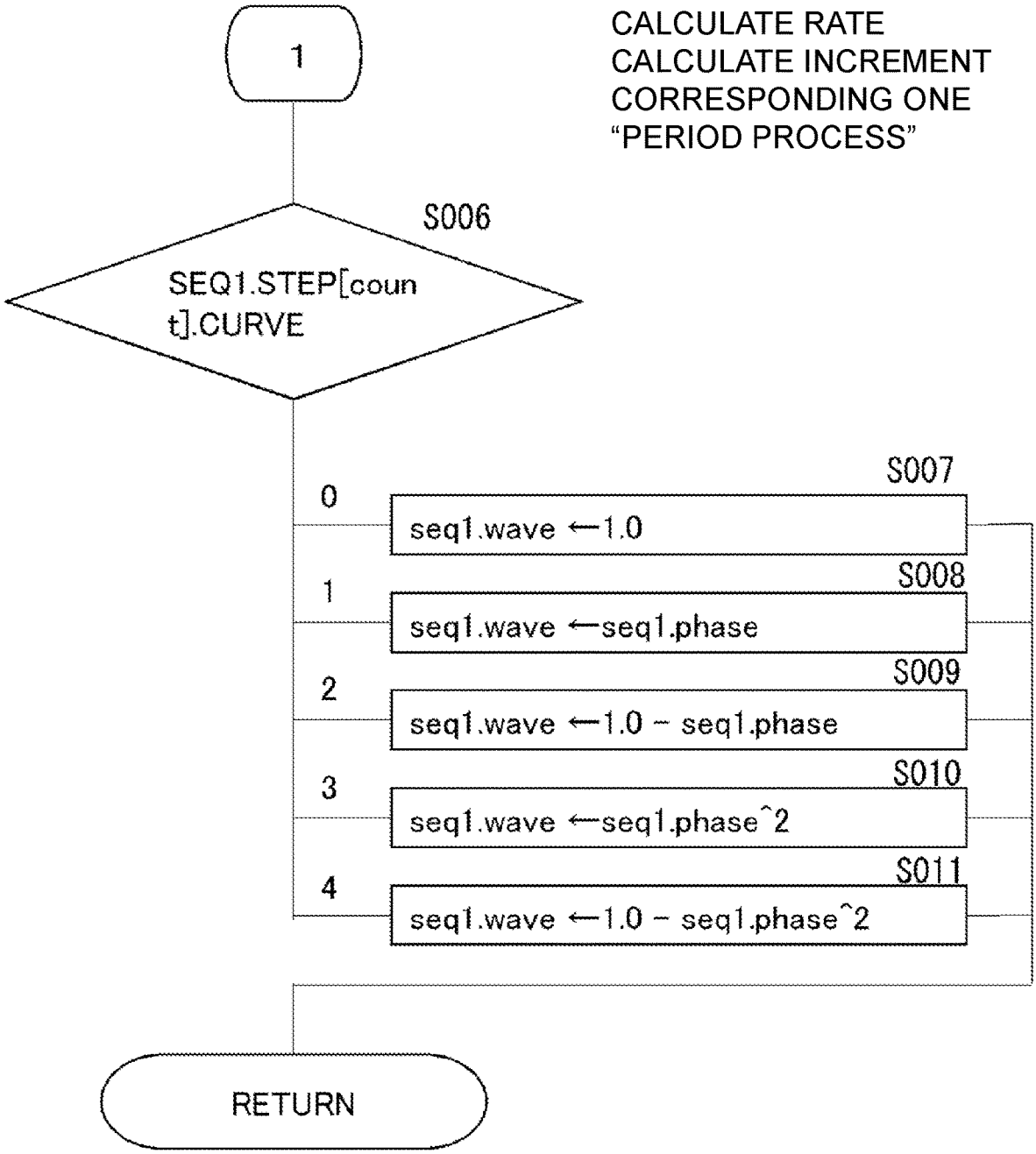
FIG. 8 illustrates an example of a signal generation process of a sequencer.

FIGS. 7 and 8 illustrate a signal generation process of the step sequencer SEQ1. The signal generation process of the step sequencer SEQ2 is the same as the signal generation process of the step sequencer SEQ1. Thus, the signal generation process of the step sequencer SEQ1 will be described representatively. The signal generation process is a process for generating a control signal (seqn.wave) changing along with elapse of time in accordance with settings of parameters of the sequencers SEQ1 and SEQ2 and is a subroutine called from the period process of the CPU 11.

Figure 9:
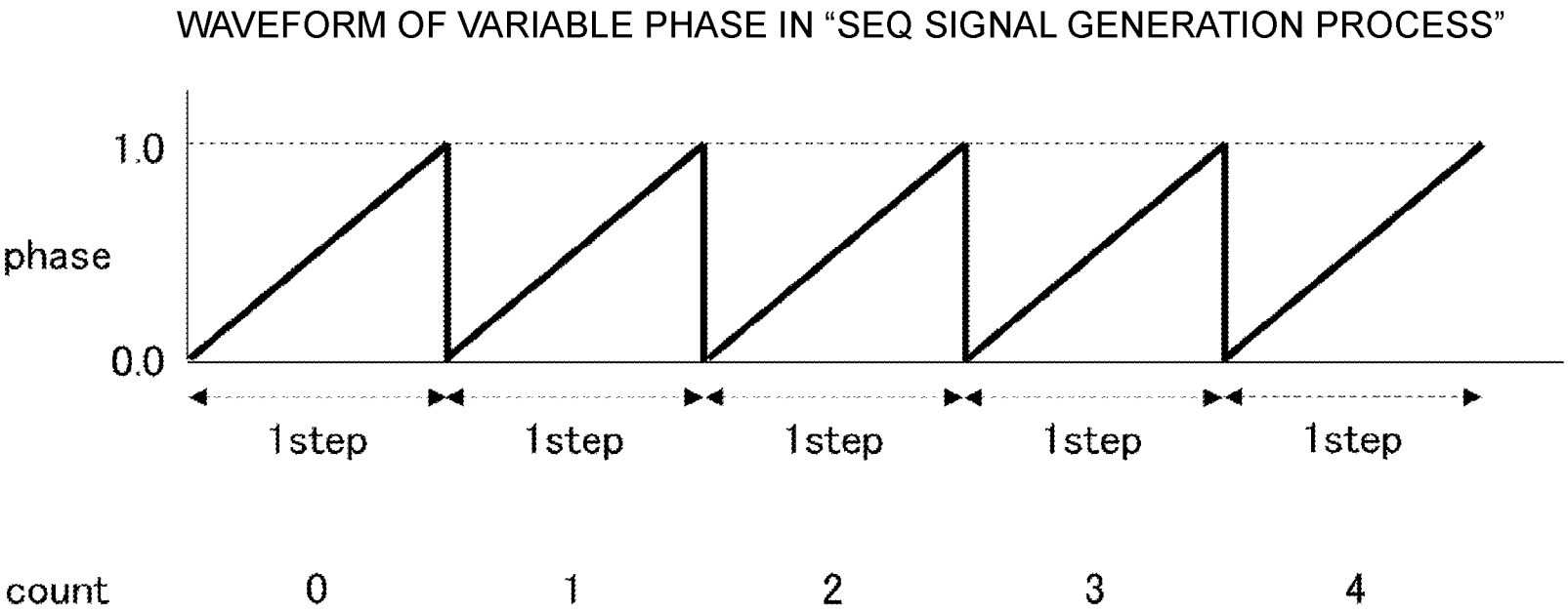
FIG. 9 illustrates an example of the waveform of a variable phase in a signal generation process.

FIG. 9 illustrates a waveform of a variable "phase (Phase)" in the signal generation process. The waveform of the phase is a sawtooth wave having a period in which the value changes from 0.0 to 1.0 as one step, and a count value (count) increments (is increased by one) every time when the value reaches 1.0. An initial value of the count value is "0" and increases to 1, 2, 3, 4 . . . .

In Step S001 illustrated in FIG. 7, the CPU 11 calculates a rate. The calculation of the rate is performed on the basis of a parameter "BPM" and a setting value of "NOTE" of the sequencer SEQ1. The calculation of the rate is a process of calculating an increment, which corresponds to one period process of the CPU 11, of the variable "phase" described above. The rate is calculated using the following equation.

$$rate=BPM/60*SEQ1.NOTE/1000$$

Here, BPM (beat per minute) represents a tempo and represents a count of beats (the number of quarter notes) within one minute. The count of beats per second is calculated by calculating BPM/60. The division using 1000 is on the basis of 1000 period processes per second. Regarding the calculation of the rate, for example, when BPM=120, and NOTE=1.0 (quarter note), rate=0.002. In this embodiment, when the subroutine of the signal generation process is called 500 times, the value of the variable "phase" (phase value) increases from 0.0 to 1.0.

In Step S002, the CPU 11 changes the phase value of the sequencer SEQ1 to a number acquired by adding the value of the calculated rate (rate value) to the current phase value in S001. In accordance with this, the value of the phase of the sequencer SEQ1 increases by the rate value.

In Step S003, the CPU 11 determines whether or not the value of a function "floor(seq1.phase)" is equal to or larger than 1.0. Here, floor(x) is a function for obtaining a largest integer that is equal to or smaller than x, and, for example, the value of floor (1.1) is 1.0. The process of Step S003 is a process for determining whether or not the phase value has reached 1.0 that is a maximum value. In a case in which the value of floor(seq1.phase) is equal to or larger than 1.0 (Yes in S003), the process proceeds to S004. Otherwise (No in S003), the process proceeds to S005.

In Step S004, the CPU 11 executes a subroutine of a Step progress process relating to the sequencer SEQ1. The progress process is a process of progressing the value of Step (step value) and a process of resetting the step value in accordance with a setting value of the number of steps (LENGTH) of the sequencer.

Figure 10:
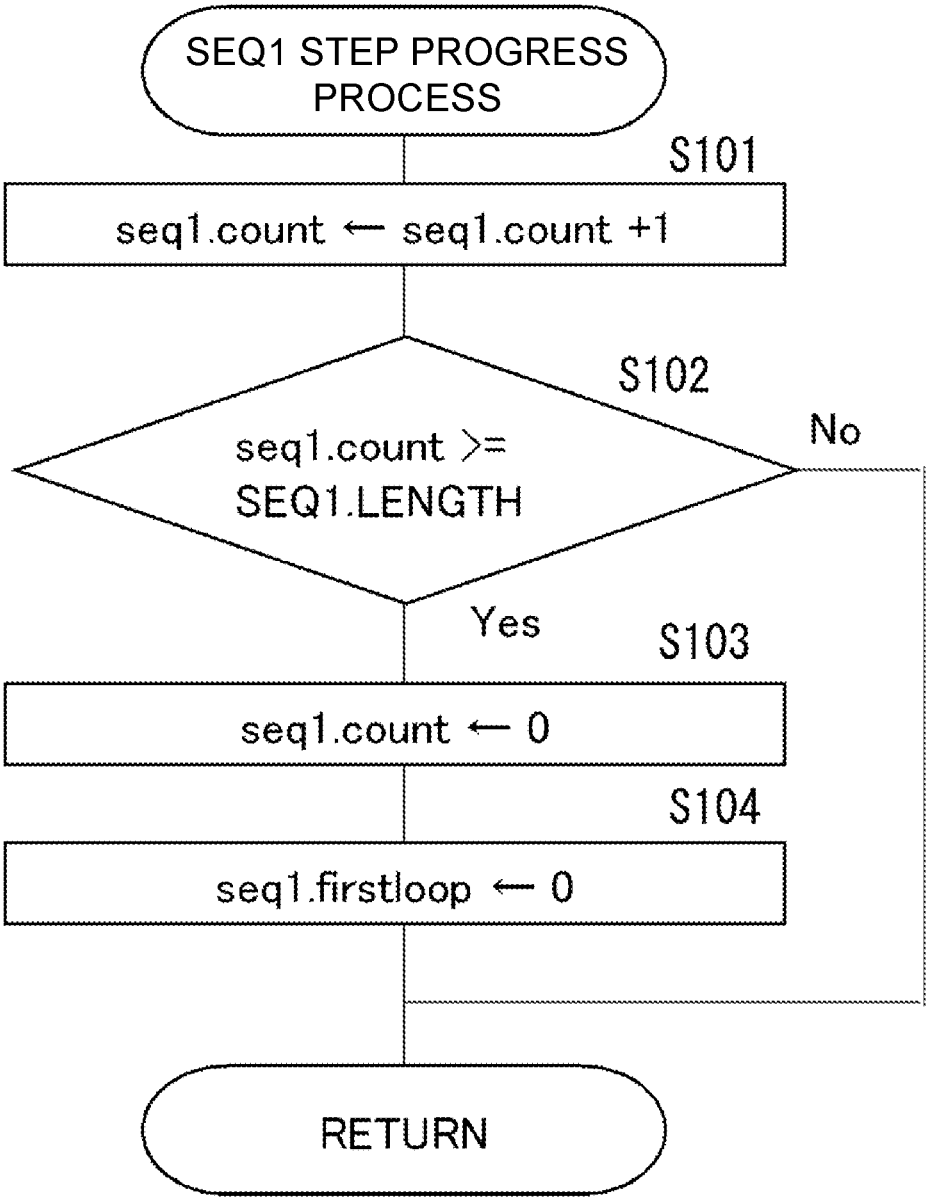
FIG. 10 illustrates an example of a step stepping process of a sequencer.

FIG. 10 is a flowchart illustrating an example of the Step progress process. Although FIG. 10 illustrates a progress process relating to the sequencer SEQ1, the same process is performed also for the sequencer SEQ2. In Step S101, the CPU 11 increments the value of the count value "seq1.count" of the sequencer SEQ1. In accordance with this, "1" is added to the count value.

In Step S102, the CPU 11 determines whether or not the current count value has reached the setting value of the number of steps (LENGTH) of the sequencer SEQ1. In a case in which it is determined that the count value has reached the setting value of the LENGTH (Yes in S102), the process proceeds to Step S103, or otherwise (No in S102), the progress process ends (returns).

In Step S103, the CPU 11 sets the current count value to "0". In Step S104, the CPU 11 sets the value of the variable "seq1.firstloop", which is a control flag of the one shot, to "0". The variable "seq1.firstloop" is a value that becomes "0" when all the steps of the LENGTH value go through one cycle. When the retrigger is taken, the value of the variable "seq1.firstloop" is set to "1" when the sequencer is on. The process of Step S104 ends, the progress process ends.

Referring to FIG. 7, in Step S005, the CPU 11 sets the phase value to a value acquired by subtracting the value of the floor (seq1.phase) from the current phase value. In Step S006, a type of curve (CURVE) set in the current step is determined.

Figure 11:
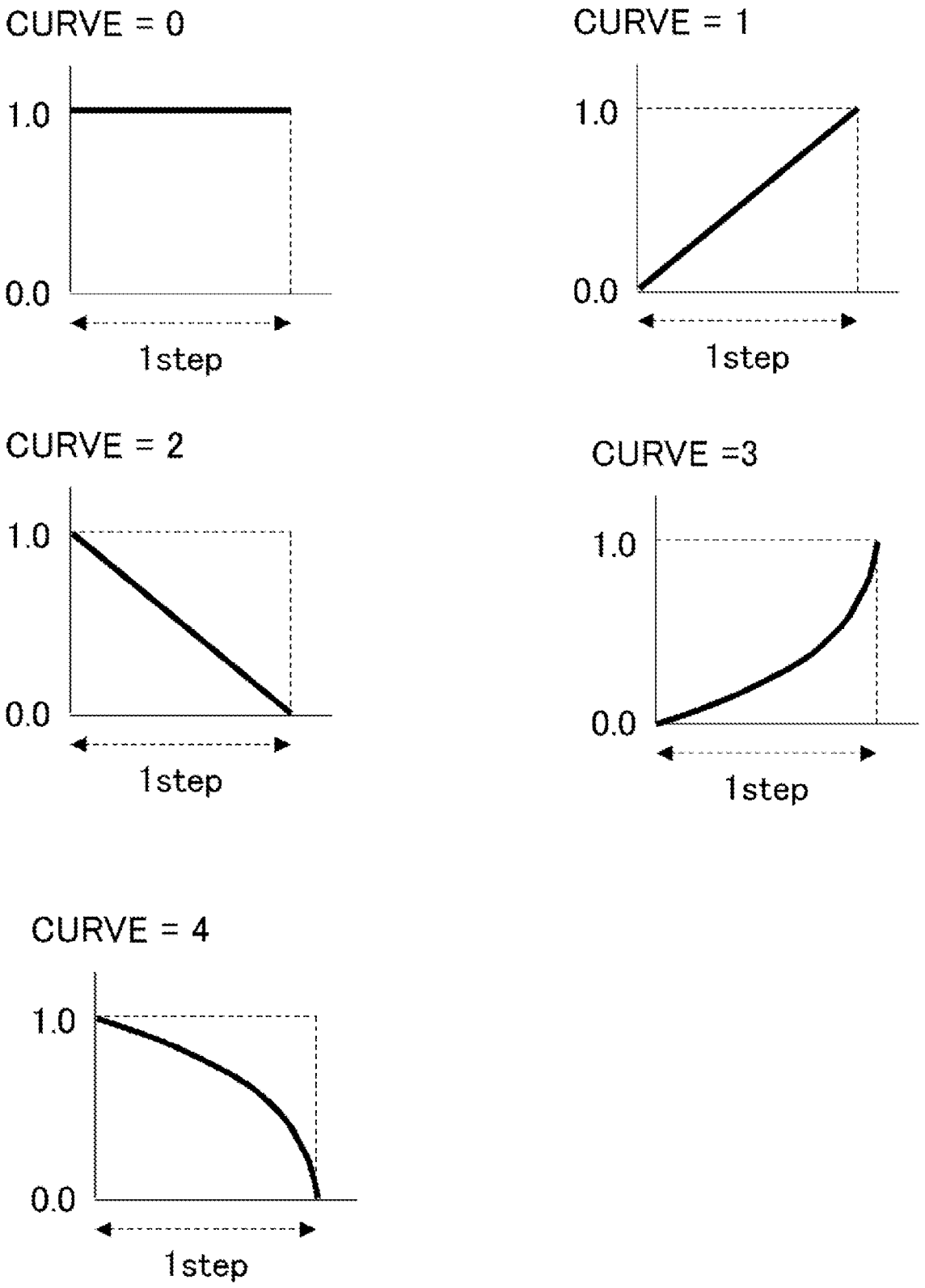
FIG. 11 illustrates an example of a waveform processing process based on a setting value of CURVE.

FIG. 11 illustrates types of curve (envelope: a change pattern of a waveform with respect to time) and change of the waveform over time. Values of Curves (curve values) are assigned to a plurality of types of curves. In the example illustrated in FIG. 11, curve values 0 to 4 are assigned to five types of curves. In a case in which the curve value=0, the value does not change to 1.0 within one step. In a case in which the curve value=1, the value linearly increases from 0.0 to 1.0 within one step. In a case in which the curve value=2, the value linearly decreases from 1.0 to 0.0 within one step. In a case in which the curve value=3, the value increases from 0.0 to 1.0 within one step while describing a curve (parabola). In a case in which the curve value=4, the value decreases from 1.0 to 0.0 within one step while describing a curve (parabola). The waveform shapes of change patterns are not limited to the examples illustrated in FIG. 11, and the number of types may be equal to or larger than 5 or may be smaller than 5.

In Step S006, the CPU 11 determines which one of 0 to 4 the curve value set using the panel P1 is. In a case in which the curve value is 0, the CPU 11 performs such a process that the waveform is the waveform of the curve value 0 (Step S007). In a case in which the curve value is 1, the CPU 11 performs such a process that the waveform is the waveform of the curve value 1 (Step S008). In a case in which the curve value is 2, the CPU 11 performs such a process that the waveform is the waveform of the curve value 2 (Step S009). In a case in which the curve value is 3, the CPU 11 performs such a process that the waveform is the waveform of the curve value 3 (Step S010). In a case in which the curve value is 4, the CPU 11 performs such a process that the waveform is the waveform of the curve value 4 (Step S011).

Figure 12:
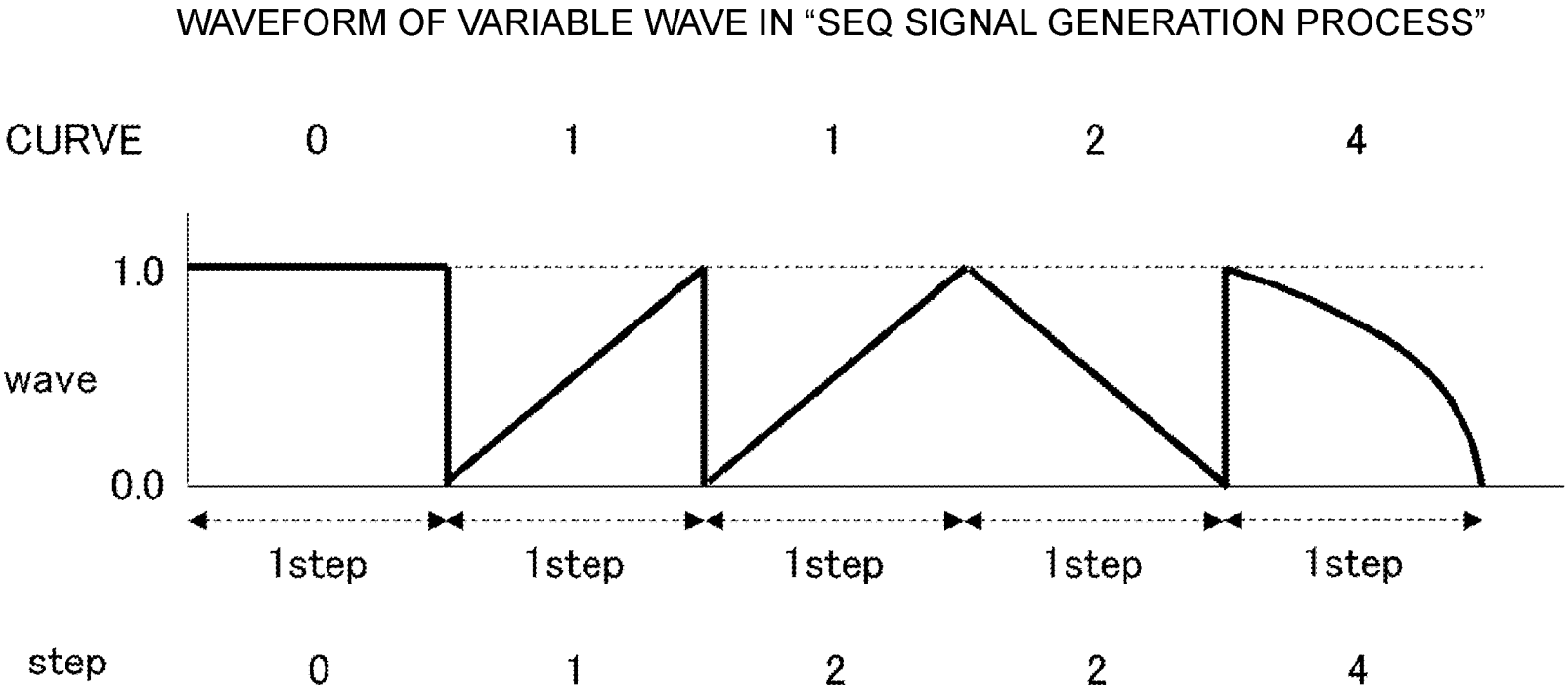
FIG. 12 illustrates an example of the waveform of a variable wave in a signal generation process.

FIG. 12 illustrates an example of the waveform of a variable wave (a control signal waveform) in the signal generation process. The example illustrated in FIG. 12 illustrates a waveform of a control signal "wave" in a case in which curve values 0, 1, 1, 2, and 4 are respectively set to steps 0 to 4 set in LENGTH. In this way, by providing a setting value of a curve to each step, a complicated waveform change (envelope) can be generated.

Figure 13:
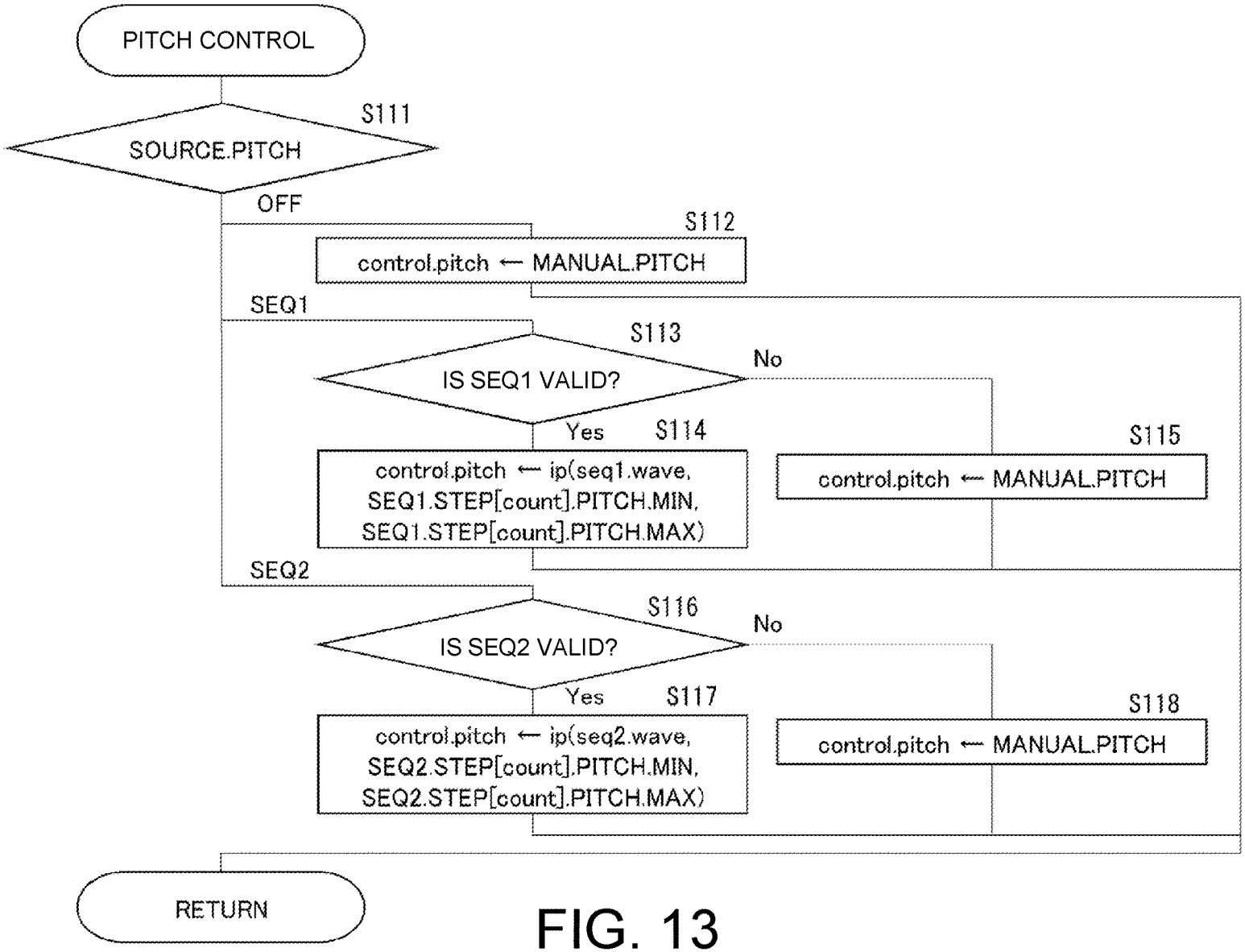
FIG. 13 illustrates an example of pitch control.

FIG. 13 is a flowchart illustrating an example of the process of pitch control (Step S03). The pitch control is performed using a control signal acquired by a signal generation process and the following parameters and variables.

SOURCE.PITCH
MANUAL.PITCH
SEQ1.STEP[count]. PITCH.MIN, SEQ1.STEP[count]. PITCH.MAX
SEQ2.STEP[count]. PITCH.MIN, SEQ2.STEP[count]. PITCH.MAX
SEQ1.ONOFF
SEQ1.ONESHOT
SEQ2.ONOFF
SEQ2.ONESHOT
seq1.firstloop
seq2.firstloop In Step S111, "SOURCE.PITCH" (a source pitch value) representing a type of pitch control is determined. The source pitch value is "OFF" in a case in which none of the buttons for "SEQ1" and "SEQ2" illustrated in FIG. 3(A) is pressed, is "SEQ1" in a case in which the button for "SEQ1" is pressed, and is "SEQ2" in a case in which the button for "SEQ2" is pressed.

The process proceeds to Step S112 in a case in which the source pitch value is determined as being "OFF", the process proceeds to Step S113 in a case in which the source pitch value is determined as being "SEQ1", and the process proceeds to Step S116 in a case in which the source pitch value is determined as being "SEQ2".

In Step S112, the CPU 11 sets the value of the variable "control.pitch" to a value of "MANUAL.PITCH" set using the knob and ends the pitch control process.

In Step S113, the CPU 11 determines whether the sequencer SEQ1 is valid. In the determination of S113, validity is determined in a case in which the following conditions are satisfied, and invalidity is determined otherwise.

```
SEQ1.ONOFF==1&&
    (SEQ1.ONESHOT==0||seq1.firstloop==1)
```

In other words, the CPU 11 determines whether the value of the variable "SEQ1.ONESHOT" is "0", and the value of the variable "seq1.firstloop" is "1". Here, the variable "SEQ1.ONESHOT" is a variable that represents on/off of the one shot. The one shot is off in a case in which the value is "0", and the one shot is on in a case in which the value is "1". As described above, the variable "seq1.firstloop" is a variable that becomes "0" in a case in which all the steps of the sequencer SEQ1 go through one cycle (see S104 illustrated in FIG. 10).

In Step S113, in a case in which the conditions are satisfied, and validity is determined, the process proceeds to S114, and, in a case in which the conditions are not satisfied, and invalidity is determined, the process proceeds to S115. In Step S115, a process that is similar to that of Step S112 is performed.

In Step S114, the CPU 11 sets the value of the variable "control.pitch" to a value obtained from the following ip function.

ip(seq1.wave,SEQ1.STEP[count].PITCH. MIN,
SEQ1.STEP[count].PITCH. MAX)

Here, the ip(wave, min, max) function is a function that is used for acquiring a value obtained by interpolating between a minimum value min and a maximum value max using a value (0.0 to 1.0) of the waveform "wave".

ip(wave,min,max):=wave*max+(1.0−wave)*min

Figure 14:
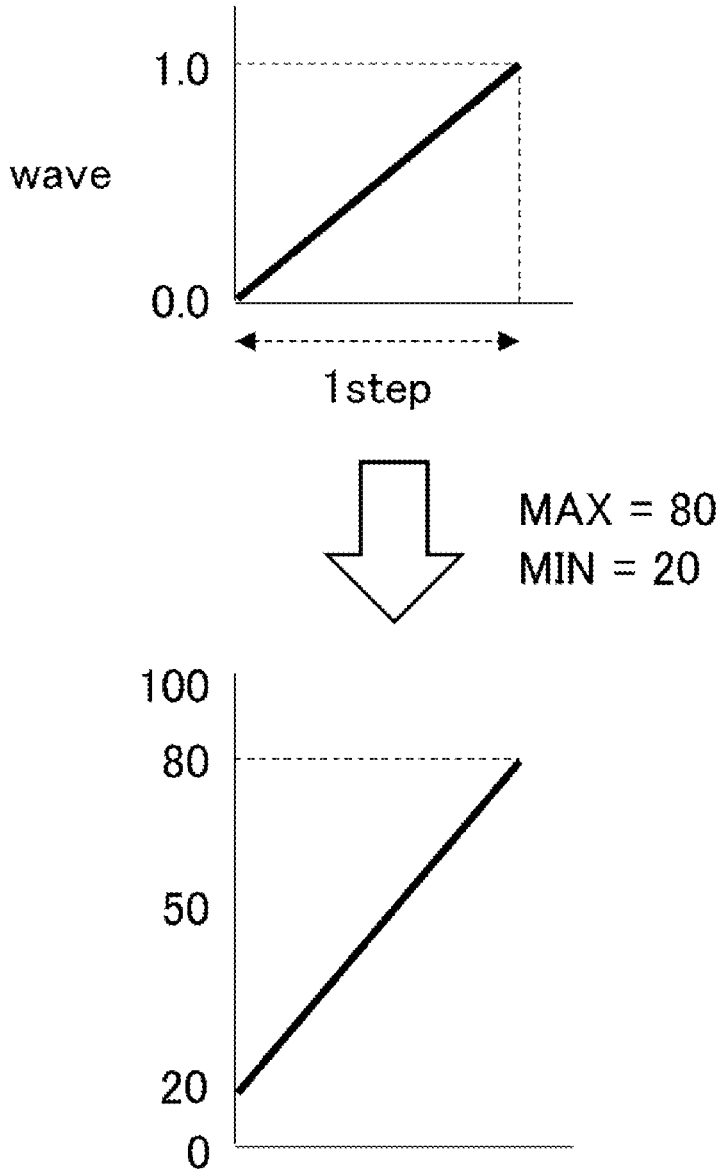
FIG. 14 illustrates operations of parameters MIN and MAX.

FIG. 14 is a diagram illustrating operations of the parameters MIN and MAX. It is assumed that the waveform "wave" exhibits a waveform linearly increasing from 0.0 to 1.0 as illustrated in an upper stage in FIG. 14. At this time, when the minimum value MIN is set to 20, and the maximum value MAX is set to 80, a minimum value of the waveform is set to 0.0 to 20, and a maximum value is set to 1.0 to 80. A waveform between the minimum value and the maximum value depends on the waveform "wave" and thus forms a linear shape.

In Step S114, the CPU 11 obtains the ip function for the waveform (seq1.wave) of a control signal "wave" of the sequencer SEQ1 and the minimum value (SEQ1.STEP [count]. PITCH.MIN) of a pitch set for the current step and the maximum value (SEQ1.STEP[count]. PITCH.MAX) of the pitch and sets the value thereof to the value of the variable "control.pitch".

The processes of Steps S116, S117, and S118 are the same as the processes of Steps S113, S114, and S115 except that the target is not the sequencer SEQ1 but the sequencer SEQ2, and thus description thereof will be omitted. The conditions for validity/invalidity of S116 are the same as the conditions for validity/invalidity of S113.

The CPU 11 stores the value of the variable "control-.pitch" acquired by the pitch control in the RAM 12 as a control value of the DSP 14. In the pitch shift 141 illustrated in FIG. 5, the DSP 14 uses the stored value of the variable "control.pitch".

In a case in which the variable "SEQ1.ONESHOT" is "0 (off)", pitch control is performed in accordance with a setting value of the sequencer SEQ1. In a case in which the variable "SEQ1.ONESHOT" is "1 (on)", when the value of the variable "seq1.firstloop" is "0", pitch control is performed in accordance with a setting value of the sequencer SEQ1. In a case in which the variable "SEQ1.ONESHOT" is "1 (on)", and the value of the variable "seq1.firstloop" is "0", pitch control is in accordance with a value of the manual setting. This means that the operation of the sequencer SEQ1 stops. Such handling is similar also for the sequencer SEQ2. In addition, similar handling is performed also for cutoff control and level control.

Figure 15:
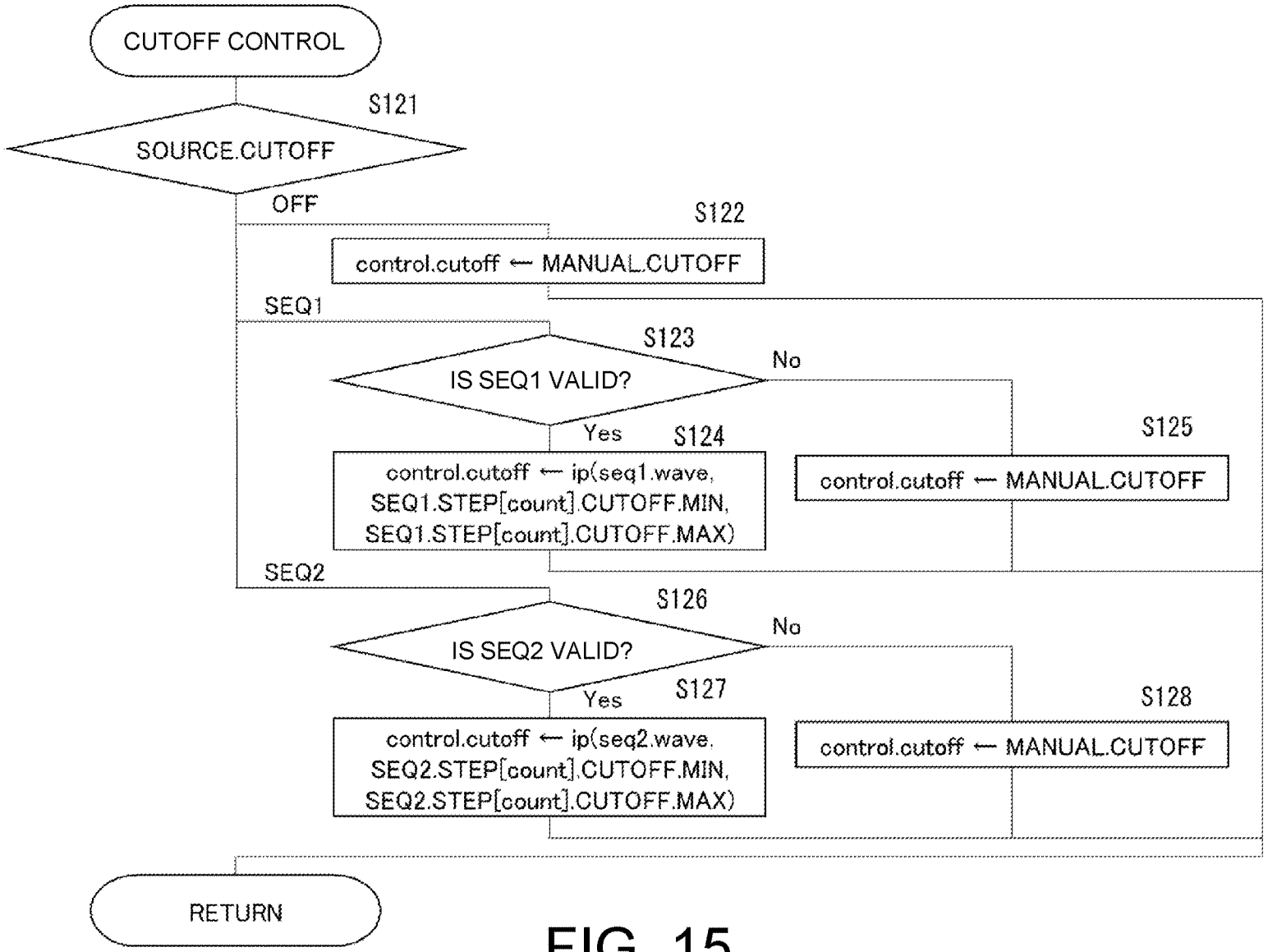
FIG. 15 illustrates an example of cutoff control.

FIG. 15 is a flowchart illustrating an example of the process of cutoff control (Step S04). The cutoff control is performed using a control signal "wave" acquired by the signal generation process and the following parameters, variables, and the like.

SOURCE.CUTOFF
MANUAL.CUTOFF
SEQ1.STEP[count]. CUTOFF.MIN, SEQ1.STEP[count]. CUTOFF.MAX
SEQ2.STEP[count]. CUTOFF.MIN, SEQ2.STEP[count]. CUTOFF.MAX
SEQ1.ONOFF
SEQ1.ONESHOT
SEQ2.ONOFF
SEQ2.ONESHOT
seq1.firstloop
seq2.firstloop In Step S121, "SOURCE.PITCH" (source cutoff value) representing a type of cutoff control is determined. The source cutoff value is "OFF" in a case in which none of the buttons for SEQ1 and SEQ2 illustrated in FIG. 3(B) is pressed, is "SEQ1" in a case in which the button for SEQ1 is pressed, and is "SEQ2" in a case in which the button for SEQ2 is pressed.

The process proceeds to Step S122 in a case in which the source cutoff value is determined as being "OFF", the process proceeds to Step S123 in a case in which the source cutoff value is determined as being "SEQ1", and the process proceeds to Step S126 in a case in which the source cutoff value is determined as being "SEQ2".

In Step S122, the CPU 11 sets the value of the variable "control.cutoff" to a value of "MANUAL.CUTOFF" set using a knob and ends the cutoff control process.

In Step S123, the CPU 11 determines whether the sequencer SEQ1 is valid. Conditions used for the determination of S123 are the same as the conditions used in Step S113. The process proceeds to S124 in a case in which validity is determined, and the process proceeds to S125 in a case in which invalidity is determined. In Step S125, the CPU 11 performs a process similar to that of Step S122.

In Step S124, the CPU 11 sets the value of the variable "control.cutoff" to a value obtained from the following ip function.

ip(seq1.wave,SEQ1.STEP[count].CUTOFF. MIN,
SEQ1.STEP[count].CUTOFF. MAX)

In other words, in Step S124, the CPU 11 obtains the ip function for the waveform (seq1.wave) of the control signal "wave" of the sequencer SEQ1 and a minimum value (SEQ1.STEP[count]. CUTOFF.MIN) of a pitch set for the current step and a maximum value (SEQ1.STEP[count]. CUTOFF.MAX) of the pitch and sets the value thereof to the value of the variable "control.cutoff".

The processes of Steps S126, S127, and S128 are the same as the processes of Steps S123, S124, and S125 except that the target is not the sequencer SEQ1 but the sequencer SEQ2, and thus description thereof will be omitted. The conditions for validity/invalidity of S126 are the same as the conditions for validity/invalidity of S123.

The CPU 11 stores the value of the variable "control.cutoff" acquired by the cutoff control in the RAM 12 as a control value of the DSP 14. In the process of the filter 142 illustrated in FIG. 5, the DSP 14 uses the stored value of the variable "control.cutoff". For example, by changing the coefficient of a multiplier included in the filter on the basis of the variable "control.cutoff", the cutoff frequency of the filter 142 can be changed. In accordance with this, an input sound (original sound) can be changed to a bright sound, a hollow sound, or the like.

Figure 16:
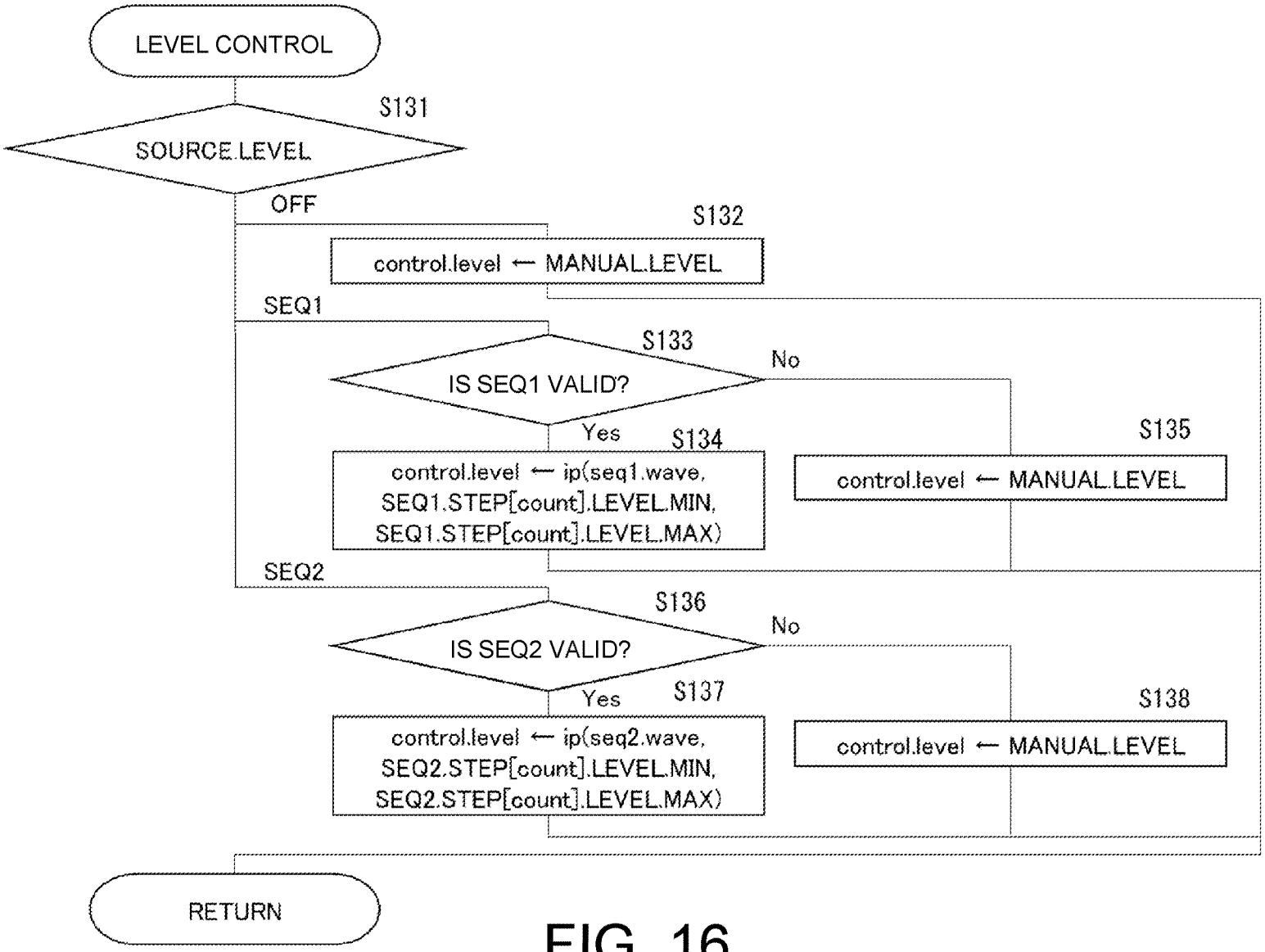
FIG. 16 illustrates an example of level control.

FIG. 16 is a flowchart illustrating an example of the process of the level control (Step S06). The level control is performed using a control signal "wave" acquired by the signal generation process and the following parameters and variables.

SOURCE.LEVEL
MANUAL.LEVEL
SEQ1.STEP[count]. LEVEL.MIN, SEQ1.STEP[count]. LEVEL.MAX SEQ2.STEP[count]. LEVEL.MIN, SEQ2.STEP[count]. LEVEL.MAX
SEQ1.ONOFF
SEQ1.ONESHOT
SEQ2.ONOFF
SEQ2.ONESHOT
seq1.firstloop
seq2.firstloop In Step S131, "SOURCE.LEVEL" (a source level value) representing a type of level control is determined. The source level value is "OFF" in a case in which none of the buttons for "SEQ1" and "SEQ2" illustrated in FIG. 3(C) is pressed, is "SEQ1" in a case in which the button for "SEQ1" is pressed, and is "SEQ2" in a case in which the button for "SEQ2" is pressed.

The process proceeds to Step S132 in a case in which the source level value is determined as being "OFF", the process proceeds to Step S133 in a case in which the source level value is determined as being "SEQ1", and the process proceeds to Step S136 in a case in which the source level value is determined as being "SEQ2".

In Step S132, the CPU 11 sets the value of the variable "control.level" to a value of "MANUAL.LEVEL" set using the knob and ends the level control process.

In Step S133, the CPU 11 determines whether the sequencer SEQ1 is valid. Conditions used for the determination of S133 are the same as the conditions used in Step S113. The process proceeds to S134 in a case in which validity is determined, and the process proceeds to S135 in a case in which invalidity is determined. In Step S135, the CPU 11 performs a process similar to that of Step S132.

In Step S134, the CPU 11 sets the value of the variable "control.level" to a value obtained from the following ip function.

ip(seq1.wave,SEQ1.STEP[count].LEVEL. MIN, SEQ1.STEP[count].LEVEL. MAX)

In other words, in Step S124, the CPU 11 obtains the ip function for the waveform (seq1.wave) of the control signal "wave" of the sequencer SEQ1 and a minimum value (SEQ1.STEP[count]. LEVEL.MIN) of a pitch set for the current step and a maximum value (SEQ1.STEP[count]. LEVEL.MAX) of the pitch and sets the value thereof to the value of the variable "control.level".

The processes of Steps S136, S137, and S138 are the same as the processes of Steps S133, S134, and S135 except that the target is not the sequencer SEQ1 but the sequencer SEQ2, and thus description thereof will be omitted. The conditions for validity/invalidity of S136 are the same as the conditions for validity/invalidity of S133.

The CPU 11 stores the value of the variable "control.level" acquired by the level control in the RAM 12 as a control value of the DSP 14. In the process of the AMP 143 illustrated in FIG. 5, the DSP 14 uses the stored value of the variable "control.cutoff". In accordance with this, the volume can be changed.

Figure 17:
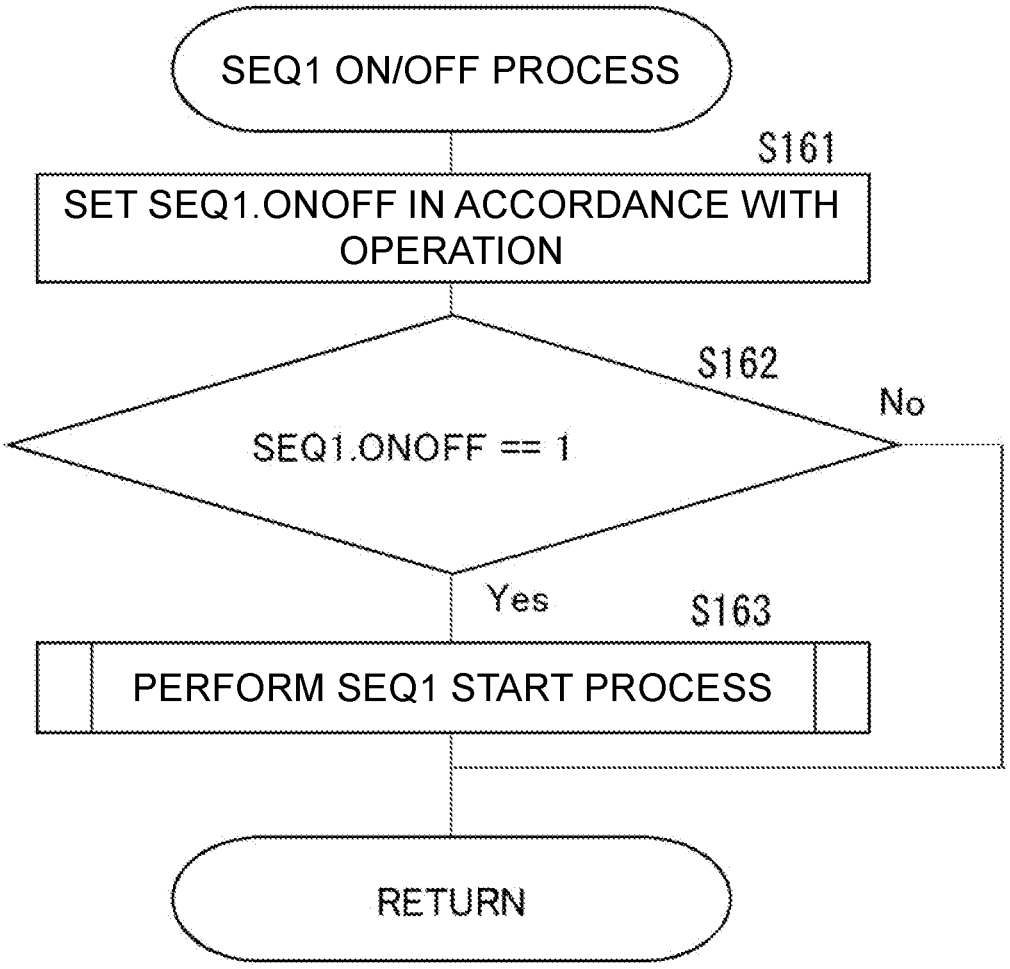
FIG. 17 illustrates an example of an on/off process of a sequencer.

FIG. 17 is a flowchart illustrating an example of an on/off process of the sequencer. The on/off process is started in accordance with an operation of the on/off button (FIG. 2) of the sequencer that is included in the operator 15. The on/off process is the same process as that of the sequencers SEQ1 and SEQ2, and FIG. 17 illustrates a process for the sequencer SEQ1.

In Step S161, the CPU 11 sets a variable "SEQ1.ONOFF" responsible for on/off of the sequencer SEQ1 in accordance with an operation of the on/off button (FIG. 2) of the sequencer SEQ1. The variable "SEQ1(SEQ2).ONOFF" represents one of on "1" and off "0" of a corresponding sequencer.

In Step S162, the CPU 11 determines whether the value of the variable "SEQ1(SEQ2).ONOFF" is "1" representing on. In a case in which the value is determined as being "0 (off)" (No in S162), the on/off process ends. On the other hand, in a case in which the value is determined as being "1 (on)", the process proceeds to Step S163. In Step S163, the CPU performs a start process of the sequencer SEQ1. When the start process ends, the on/off process ends.

Figure 18:
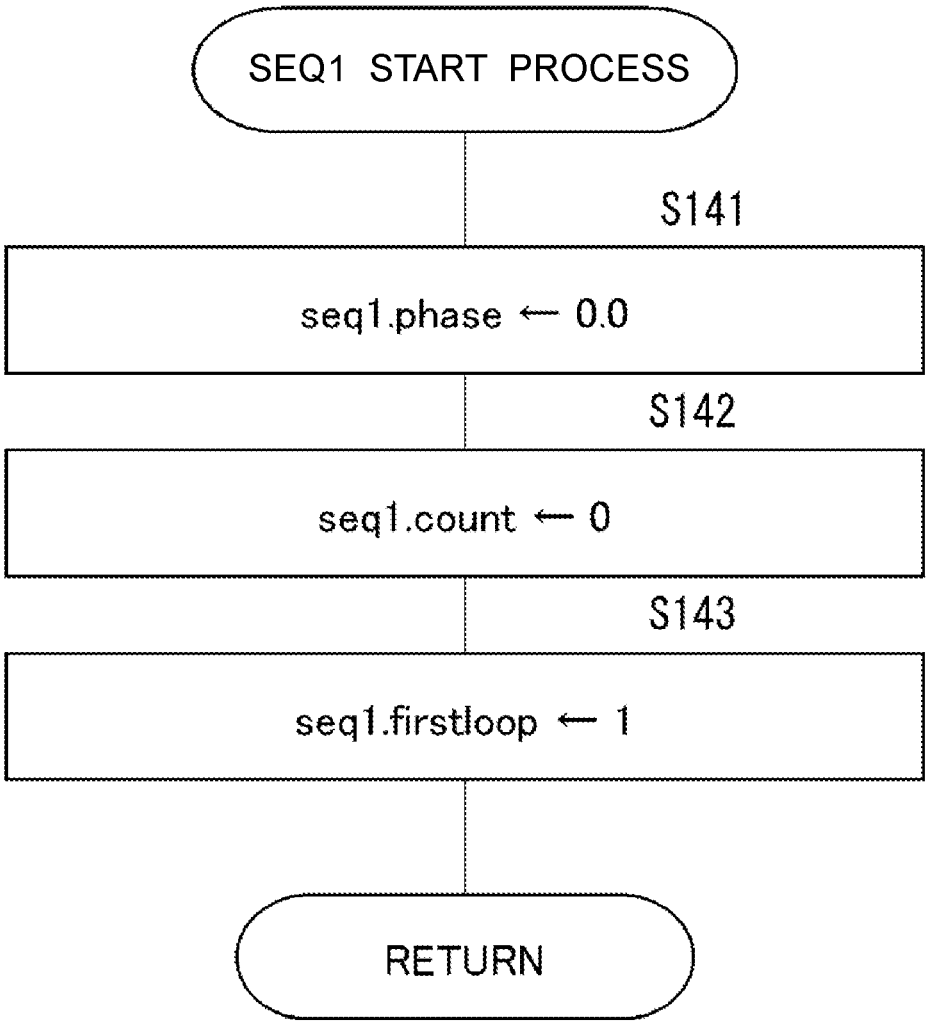
FIG. 18 illustrates an example of start process of a sequencer.

FIG. 18 is a flowchart illustrating an example of the start process of the sequencer SEQ1. The start process is the same process for the sequencers SEQ1 and SEQ2, and FIG. 18 illustrates a process for the sequencer SEQ1.

In Step S141, the CPU 11 sets the value of the variable "seq1.phase" representing the phase of the sequencer SEQ1 to 0.0 that is an initial value. In Step S142, the CPU 11 sets the value of the variable "seq1.count" representing the number of steps of the sequencer SEQ1 to 0 that is an initial value. In Step S143, the CPU 11 sets the value of the variable "seq1.firstloop" to 1. Thereafter, the start process ends.

Figure 19:
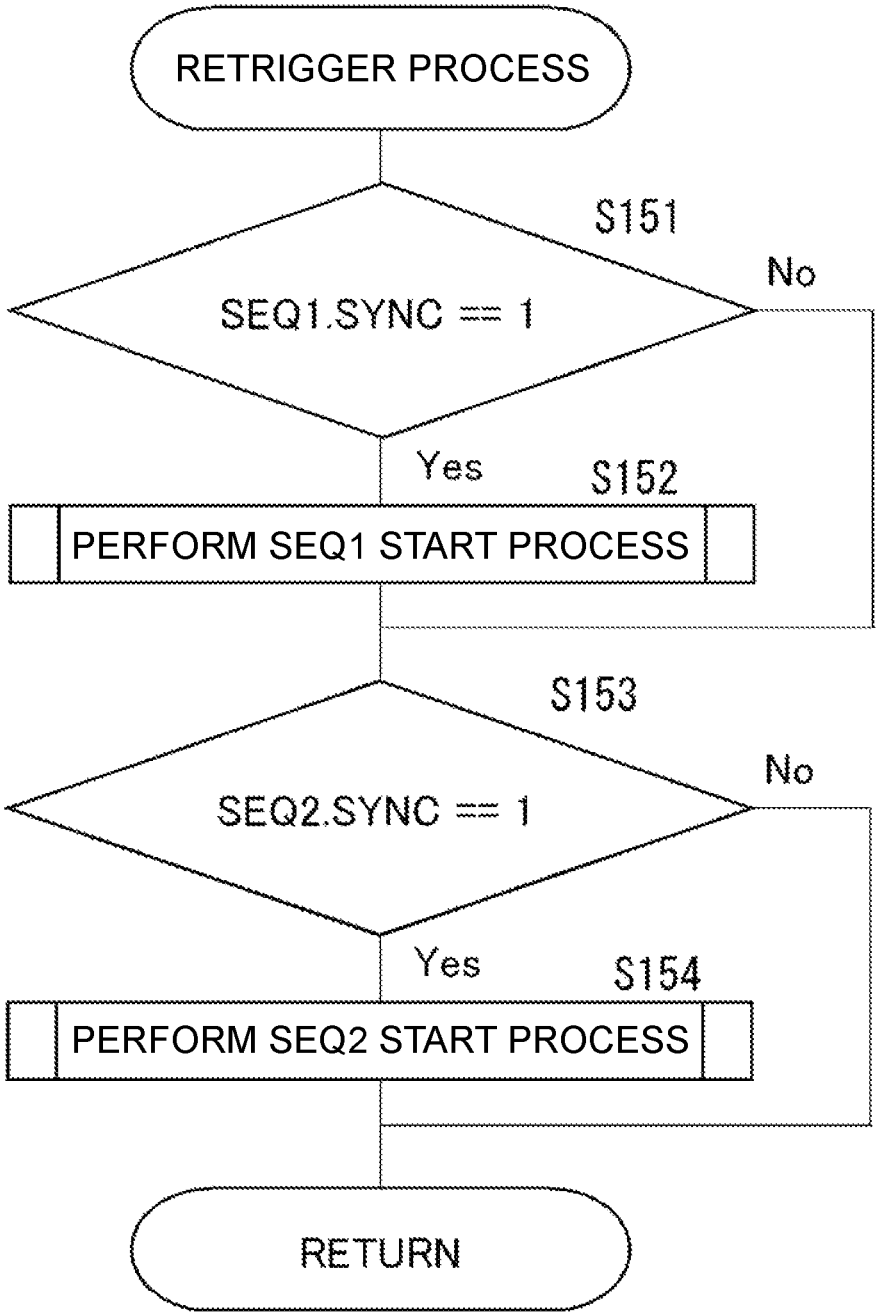
FIG. 19 illustrates an example of a retrigger process.

FIG. 19 is a flowchart illustrating an example of a retrigger process. The retrigger process is started in accordance with an operation of the retrigger button (FIG. 2) included in the operator 15. The values of the variables "SEQ1.SYNC" and "SEQ2.SYNC" are "1" in a case in which the synchronization (SYNC) button illustrated in FIG. 2 is on and are "0" in a case in which the synchronization button is off.

In Step S151, the CPU 11 determines whether or not the value of the variable "SEQ1.SYNC" is "1 (on)". The process proceeds to Step S152 in a case in which the value is determined as being "1 (on)", and the process proceeds to Step S153 otherwise.

In Step S152, the CPU 11 executes the start process (FIG. 18) of the sequencer SEQ1 and causes the process to proceed to Step S153. In Step S153, the CPU 11 determines whether or not the value of the variable "SEQ2.SYNC" is "1 (on)". The process proceeds to Step S154 in a case in which the value is determined as being "1 (on)", and the retrigger process ends otherwise. In Step S154, a start process of the sequencer SEQ2 is executed, and thereafter the retrigger process ends.

In addition, in the retrigger process, the start processes of the sequencers SEQ1 and SEQ2 may be continuously performed in the case of "SYNC" on" by setting the variables "SEQ1.SYNC" and "SEQ2.SYNC" as common variables.

In the musical sound control device 10 described above, the sequencers (SEQ1 (a first musical sound processing part) and SEQ2 (a second musical sound processing part)) repeats the process of the DSP 14 controlling a musical sound in each of a plurality of steps in accordance with control information ("control.pitch" and the like). Here, in a case in which a predetermined condition (one shot is "1", and firstloop is "0") is satisfied, when the process of controlling a musical sound for a plurality of all the steps set in the sequencer goes through one cycle, the CPU 11 stops the operation of the sequencer. The above-described condition of the one shot being "1", and the firstloop being "0" is an example in which "a value for causing the operation of the musical sound processing part to stop through one cycle and, and a flag representing that the process of controlling a musical sound for the plurality of all the steps described above has gone through one cycle is set". In a case in which the sequencer stops, generation of a musical sound (control of a pitch cutoff frequency and a volume) according to a manual setting is performed.

According to such a musical sound control device 10, there are the following advantages. When the one shot is on, at a time point at which all the processes of steps set in the sequencer (SEQ1 and SEQ2) end, the sequencer stops operations without returning the process to the first step. In accordance with this, pitch control, cutoff control, and level control for an input sound (original sound) are performed in accordance with a manual setting value. In this way, a musical effect that has not been unprecedented until now can be acquired.

In addition, according to the musical sound control device 10, change patterns of a plurality of types of control signal waveforms (a plurality of change patterns representing changes of values represented by control information within a step with respect to time) in one step are prepared as a plurality of types of curve, and a change pattern can be determined for each step set by the sequencer. In this way, a control signal "wave" can be generated using a combination of change patterns of all the steps, and an automatic play sound of the sequencer that is rich in amusement can be generated.

The values represented by the control information may include a setting value (control.picth) for controlling the pitch of a musical sound to be generated for each of a plurality of steps, a setting value (control.cutoff) for controlling the cutoff frequency of a musical sound to be generated for each of a plurality of steps, and a setting value (control.level) for controlling the volume of a musical sound to be generated for each of a plurality of steps. In this way, changes of the pitch, the cutoff frequency, and the volume with respect to time within one step can be individually controlled.

In addition, in the musical sound control device 10, a sequencer (a musical sound processing part) is formed from a sequencer SEQ1 (a first musical sound processing part) and a sequencer SEQ2 (a second musical sound processing part) of which control information is individually set and which can operate in parallel with each other. Then, in a case in which the retrigger button is pressed, and a retrigger instruction is received in a state in which synchronization between the sequencers SEQ1 and SEQ2 is set (synchronization on), the CPU 11 (control part) starts processes of first steps among a plurality of steps set in the sequencers SEQ1 and SEQ2 with timings thereof matched (simultaneously). In accordance with this, in a case in which the sequencers SEQ1 and SEQ2 of which the numbers of steps are different from each other operate in parallel, the operations can be simultaneously started from the start at appropriate timings.

Figure 20:
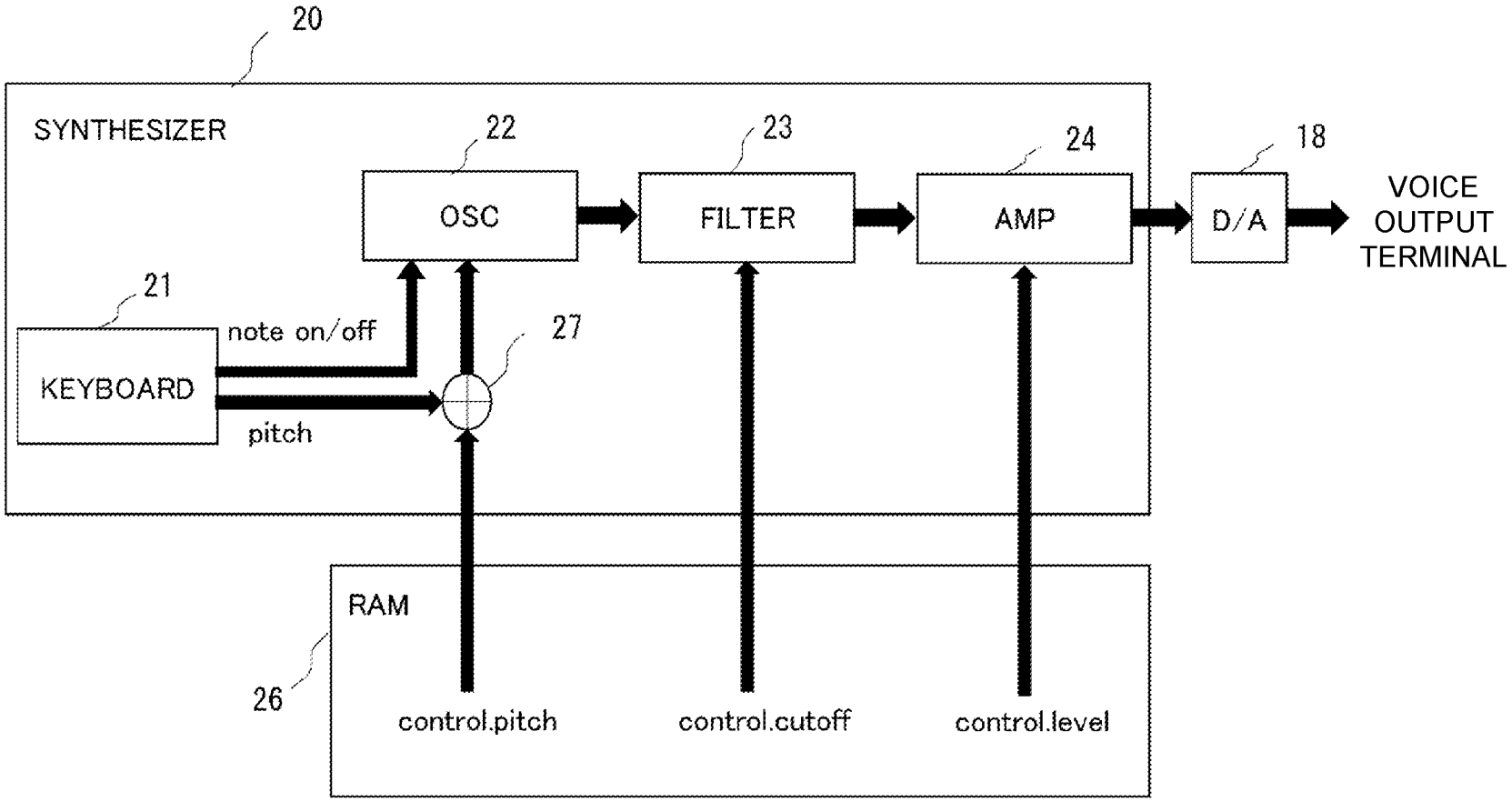
FIG. 20 illustrates an application example for a synthesizer.

The process of the CPU 11 of the musical sound control device 10 illustrated in FIG. 1 also can be applied to a synthesizer. FIG. 20 illustrates an example, in which variables "control.pitch", "control.cutoff", and "control.level" stored in RAM 26 and generated by the CPU 11 are applied to a synthesizer 20. The synthesizer 20 includes a keyboard 21 that is a play operator, and signals indicating note-on (key pressed) and note-off (key released) of keys of the keyboard are input to an oscillator (OSC) 22.

In addition, pitch information (pitch) corresponding to a pressed key is output from the keyboard 21. The pitch information has a value of 0 to 127 and represents a value that indicates a sound height of one halftone notch. An adder 27 adds the value of the variable "control.pitch" to pitch information transmitted from the keyboard 21 and inputs a resultant value to the OSC 22.

The OSC 22 is a musical sound generator and performs the following operations.

Acceptance of input of note on/off event

Start of output of musical sound generated in a predetermined waveform when a note on event is received Stop of output of musical sound (no sound is output) when a note off event is received Input of pitch information Reflection of signal generated by musical sound generated on frequency A filter (FILTER) 23 and an amplifier (AMP) 24 are respectively similar to the filter 142 and the amplifier 143, a cutoff frequency is controlled using the variable "control. cutoff", and a volume is controlled using the variable "control.level".

Although the synthesizer 20 having the keyboard 21 similar to a piano has been illustrated, a musical sound generated by the OSC 22 is not limited to a simulated sound of the piano but may be a musical sound simulating a play sound of a guitar like a guider synthesizer. The configurations illustrated in the embodiment may be appropriately combined in a range not departing from the objective.

In the musical sound control device, it may be configured such that the predetermined condition is that a value for stopping the operation of the musical sound processing part in one cycle is set, and a flag representing that control of a musical sound for the plurality of all the steps has gone through one cycle is set.

In the musical sound control device, the control part may be configured to set a change pattern selected from among a plurality of change patterns representing change of a value represented by the control information with respect to time within a step to each of the plurality of steps.

In the musical sound control device, the value represented by the control information may be configured to change between a minimum value and a maximum value in accordance with the change pattern set to each of the plurality of steps.

In the musical sound control device, the value represented by the control information may be configured to include a setting value used for controlling a pitch of a musical sound generated for each of the plurality of steps.

In addition, in the musical sound control device, the value represented by the control information may be configured to include a setting value used for controlling a cutoff frequency of a musical sound generated for each of the plurality of steps.

In addition, in the musical sound control device, the control information may be configured to include a setting value used for controlling a volume of a musical sound generated for each of the plurality of steps.

In the musical sound control device, the musical sound processing part may be configured to be formed from a first musical sound processing part and a second musical sound processing part to which the control information is individually set and which can operate in parallel, and the control part may be configured to start processes of first steps among the plurality of steps set to the first musical sound processing part and the second musical sound processing part with timings thereof matched in a case in which a retrigger instruction is received in a state in which synchronization between the first musical sound processing part and the second musical sound processing part is set.

In addition, according to one embodiment of the present disclosure, there is provided a musical sound control method including: controlling a musical sound in each of a plurality of steps in accordance with control information set by a plurality of operators by using a musical sound control device; and stopping the process of controlling the musical sound in a case in which the process of controlling the musical sound has gone through one cycle in a case in which a predetermined condition is satisfied by using the musical sound control device.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

REFERENCE SIGNS LIST

10 Musical sound control device
11 CPU
12 RAM
13 ROM
14 DSP
15 Operator
16 Display

What is claimed is:

1. A musical sound control device, comprising:

a plurality of operators;

a musical sound processing part, configured to repeat a process of controlling a first musical sound in each of a first plurality of steps in accordance with control information set by the plurality of operators to generate a second musical sound having a second plurality of steps; and a control part, configured to stop an operation of the musical sound processing part in a case in which the process of controlling the musical sound of all of the first plurality of steps using the musical sound processing part has gone through one cycle in a case in which a predetermined condition is satisfied, wherein the one cycle is one iteration of generating all of the second plurality of steps of the second musical sound which comprises a plurality of phoneme pieces and the predetermined condition comprises a value representing whether the generating of the second musical sound is to be stopped after one cycle and whether a flag representing that the generating of the second musical sound for all of the second plurality of steps has gone through one cycle has been set.

2. The musical sound control device according to claim 1, wherein the control part sets, within each step of the plurality of steps, a change pattern selected from among a plurality of change patterns, the change pattern representing a change of a value with respect to time dictated by the control information.

3. The musical sound control device according to claim 2, wherein the value represented by the control information changes between a minimum value and a maximum value in accordance with the change pattern set to each of the first plurality of steps.

4. The musical sound control device according to claim 3, wherein the value represented by the control information includes a setting value used for controlling a pitch of the first musical sound generated for each of the first plurality of steps.

5. The musical sound control device according to claim 3, wherein the value represented by the control information includes a setting value used for controlling a cutoff frequency of the first musical sound generated for each of the plurality of steps.

6. The musical sound control device according to claim 3, wherein the control information includes a setting value used for controlling a volume of the first musical sound generated for each of the first plurality of steps.

7. The musical sound control device according to claim 1, wherein the control information sets at least one of a first musical sound processing part and a second musical sound processing part as the musical sound processing part and each of the first musical sound processing part and the second musical sound processing part is individually set and which can operate in parallel in order for one of the first musical sound processing part or the second musical sound processing part to generate the second musical sound based on the first musical sound and the other one of the first musical sound processing part or the second musical sound processing part to generate a third musical sound based on the first musical sound, and wherein in response to receiving a retrigger instruction to synchronize the first musical sound processing part and the second musical sound processing part, the control part is further configured to match a timing between a first step of the second plurality of steps of the second musical sound generated by the first musical sound processing part and a first step of a third plurality of steps of the third musical sound generated by the second musical sound processing part.

8. The musical sound control device according to claim 1, wherein, when the control part stops the operation of the musical sound processing part, an operation at the time of stopping the operation at which the musical sound processing part stops the operation is performed, and, at the time of stopping the operation, control performed by the musical sound processing part stops, and control is performed in accordance with a manual setting value.

9. A musical sound control device, comprising:

a plurality of operators;

a musical sound processing part, configured to repeat a process of controlling a musical sound which comprises a plurality of phoneme pieces where a cycle of the musical sound is assigned as a plurality of steps, each of the plurality of steps is set by the plurality of operators in accordance with control information; and a control part, configured to set, within each step of the plurality of steps, a change pattern selected from among a plurality of change patterns, wherein the change pattern represents a change of a value with respect to time dictated by the control information.

10. The musical sound control device according to claim 9, wherein the value represented by the control information changes between a minimum value and a maximum value in accordance with the change pattern set to each of the plurality of steps.

11. The musical sound control device according to claim 9, wherein the value represented by the control information includes a setting value used for controlling a pitch of a musical sound generated for each of the plurality of steps.

12. The musical sound control device according to claim 9, wherein the value represented by the control information includes a setting value used for controlling a cutoff frequency of a musical sound generated for each of the plurality of steps.

13. The musical sound control device according to claim 9, wherein the control information includes a setting value used for controlling a volume of a musical sound generated for each of the plurality of steps.

14. The musical sound control device according to claim 9, wherein the musical sound processing part is formed from a first musical sound processing part and a second musical sound processing part to which the control information is individually set and which can operate in parallel, and wherein the control part starts processes of first steps among the plurality of steps set to the first musical sound processing part and the second musical sound processing part with timings thereof matched in a way that a first step of the plurality of steps of the musical sound having been processed by the first musical sound processing part aligns in timing with a first step of the plurality of steps of the musical sound having been processed by the second musical sound processing part in a case in which a retrigger instruction is received in a state in which synchronization between the first musical sound processing part and the second musical sound processing part is set.

15. A musical sound control method, comprising:

repeating a process of controlling a first musical sound in each of a first plurality of steps in accordance with control information set by a plurality of operators to generate a second musical sound having a second plurality of steps; and stopping an operation of the musical sound processing part in a case in which the process of controlling the musical sound of all of the first plurality of steps using the musical sound processing part has gone through one cycle in a case in which a predetermined condition is satisfied, wherein the one cycle is one iteration of generating all of the second plurality of steps of the second musical sound which comprises a plurality of phoneme pieces and the predetermined condition comprises a value representing whether the generating of the second musical sound is to be stopped after one cycle and whether a flag representing that the generating of the second musical sound for all of the second plurality of steps has gone through one cycle has been set.

16. The musical sound control method according to claim 15, wherein the value represented by the control information changes between a minimum value and a maximum value in accordance with the change pattern set to each of the plurality of steps.

17. The musical sound control method according to claim 15, wherein the value represented by the control information includes a setting value used for controlling a pitch of a musical sound generated for each of the plurality of steps.

18. The musical sound control method according to claim 15, wherein the value represented by the control information includes a setting value used for controlling a cutoff frequency of a musical sound generated for each of the plurality of steps.

19. The musical sound control method according to claim 15, wherein the control information includes a setting value used for controlling a volume of a musical sound generated for each of the plurality of steps.

* * * * *